US005988071A

United States Patent [19]

Taylor

[11] Patent Number: 5,988,071

[45] Date of Patent: Nov. 23, 1999

[54] PENETRATOR HAVING MULTIPLE IMPACT SEGMENTS, INCLUDING AN EXPLOSIVE SEGMENT

[75] Inventor: Robert J. Taylor, Arlington, Tex.

[73] Assignee: Lockheed Martin Corporation, Bethesda, Md.

[21] Appl. No.: 09/071,088

[22] Filed: May 1, 1998

Related U.S. Application Data

[63] Continuation-in-part of application No. 08/915,652, Aug. 21, 1997, abandoned.

[51] Int. Cl.[6] ..... F42B 12/20; F42B 12/04

[52] U.S. Cl. ..... 102/473; 102/388; 102/517; 102/489; 244/3.28; 244/3.3

[58] Field of Search ..... 102/357, 388, 102/393, 394, 439, 473, 478, 489, 501, 504, 506, 517–519, 521; 244/3.24–3.3

[56] References Cited

U.S. PATENT DOCUMENTS

| | | | |
|---|---|---|---|
| H905 | 4/1991 | Rottenberg | 244/3.28 |
| 395,881 | 1/1889 | Cunningham . | |
| 1,146,484 | 7/1915 | Dunwoody | 102/478 |
| 2,804,823 | 9/1957 | Jablansky | 102/49 |
| 3,838,644 | 10/1974 | Prochnow et al. | 102/56 |
| 4,492,166 | 1/1985 | Purcell | 102/384 |
| 4,516,502 | 5/1985 | Klein et al. | 102/523 |
| 4,565,340 | 1/1986 | Bains | 244/3.2 |
| 4,635,556 | 1/1987 | Boecker et al. | 102/518 |
| 4,708,064 | 11/1987 | Bisping et al. | 102/517 |
| 4,716,834 | 1/1988 | Wallow et al. | 102/519 |
| 4,860,660 | 8/1989 | Synofzik et al. | 102/501 |
| 4,901,645 | 2/1990 | Bisping et al. | 102/521 |
| 4,907,512 | 3/1990 | Arene | 102/476 |
| 5,003,886 | 4/1991 | Pahnke et al. | 102/521 |
| 5,088,416 | 2/1992 | Sabranski | 102/517 |
| 5,526,752 | 6/1996 | Dahl et al. | 102/517 |

FOREIGN PATENT DOCUMENTS

| | | | |
|---|---|---|---|
| 2535450 | 4/1984 | France . | |
| 1231139 | 12/1966 | Germany | 244/3.28 |
| 3834925 | 4/1990 | Germany . | |
| 4007810 | 9/1991 | Germany . | |
| 4031208 | 4/1992 | Germany . | |

*Primary Examiner*—Harold J. Tudor
*Attorney, Agent, or Firm*—Sidley & Austin

[57] ABSTRACT

A penetrator having a plurality of stacked penetrator segments is disclosed. One or more of the segments contains an explosive element Each segment has a nose portion and a rear portion. The rear portion of each segment has a rearwardly opening cavity therein and a plurality of fins pivotally mounted thereon. The segments are stacked such that the cavity of the forwardmost segment contains the nose portion of the following segment, and the following segments are similarly positioned such that the nose portion of each following segment is positioned in the cavity of the immediately preceding segment. The fins of each segment are restrained in a stowed position when the cavity of the respective segment contains the nose portion of a following segment. Upon initiation of deployment of the penetrator, aerodynamic drag against the tail portion of the rearmost segment causes the rearmost segment to separate from the stack of segments by withdrawing from the cavity of the preceding segment, which thereby allows the fins of the preceding segment to deploy, which in turn causes that segment to separate from the remaining stack of segments. Each segment aerodynamically separates from the stack in a like manner, until all of the segments have separated. The penetrator is then in a fully deployed configuration such that each segment can separately impact a target. When a segment containing an explosive element impacts the target, the explosive element contained therein explodes.

108 Claims, 5 Drawing Sheets

PENETRATOR HAVING MULTIPLE IMPACT SEGMENTS, INCLUDING AN EXPLOSIVE SEGMENT

This application is a continuation-in-part of application Ser. No. 08/915,652 filed Aug. 21, 1997, now abandoned.

TECHNICAL FIELD OF THE INVENTION

The present invention relates to a projectile weapon for penetrating targets, and more particularly to a penetrator having a plurality of penetrator segments that aerodynamically separate during flight and then sequentially impact a target, with one or more of the penetrator segments containing an explosive element.

BACKGROUND OF THE INVENTION

It is desirable to have a weapon that can destroy a variety of targets. For example, targets such as command and control centers are often buried underground and hardened with reinforced concrete overburdens. Heavily armored targets such as heavy tanks may be protected by multiple layers of hard armor, the defeat of which requires substantial penetration capability focused on a single impact point on the target. The defeat of other targets such as light armored vehicles and unarmored trucks can be enhanced by multiple impacts in different locations on the target.

One type of weapon that can be used to penetrate and destroy these kinds of targets is a projectile which impacts and penetrates a target by virtue of its kinetic energy, rather than by explosive energy. However, when such a projectile consists of only a single penetrator element, substantial stresses may be applied to the projectile by initial contact with the target or by certain features of the armor protection, and the impact may result in the breakup of the projectile with very little damage to the target. In addition, when a penetrator is employed at hypervelocity, a single large impacting element is not as effective in penetration of heavy armor as the same mass divided into a plurality of impact segments that each impact the target in the same location.

Thus, improved penetration can be achieved by a projectile having multiple penetrator segments that sequentially impact the target. U.S. Pat. No. 5,088,416 discloses one such projectile having multiple impact bodies positioned sequentially along a central rod which holds the impact bodies in initial axial alignment. After a predetermined flight time, the impact bodies are released and biased apart by springs or dished washers so that the impact bodies spread apart along the rod. The impact bodies then successively impact the target so that each impact body independently attacks the target with its full kinetic energy.

Similarly, U.S. Pat. No. 4,716,834 discloses a projectile having a prepenetrator and a main penetrator. The prepenetrator contains a plurality of stacked cylindrical cores in axial alignment with each other. Centering and/or fixing means between the cores include a weakened portion so as to achieve a fracturing or separation upon the application of a predetermined load. When the projectile impacts a target, the leading core in the stack impacts the target and disintegrates, followed by the impact of the next core in the stack, and so on until all the cores have successively impacted the target. U.S. Pat. No. 4,708,064 discloses a similar projectile having a plurality of stacked cores contained within the projectile. The cores are interfitted and connected together by centering and/or fixing means which break upon impact, such as a thin-walled and comparatively soft casing or easily rupturable pins, which hold the cores in alignment until impact. When the projectile impacts a target, each core sequentially impacts the target in the same location while the centering and/or fixing means tear away from the impact so as not to adversely interfere with the impact of each core. U.S. Pat. No. 4,635,556 discloses a penetrator that has a stack of interfitted core elements having partially convex front faces and complementary partially concave rear faces, and which are contained within a casing. A main penetrator body interfits with the rearmost core element and a tip at the front of the forwardmost core elements presses the core elements toward the main penetrator body. The core elements form radially outwardly open annular grooves at the faces which allow the penetrator to break apart at these grooves. Upon reaching the target, each core element sequentially impacts the target.

Other kinds of multistage penetrators include the projectile disclosed by U.S. Pat. No. 5,526,752, which contains multiple warheads mounted in tandem within the casing of the projectile. Upon reaching a target, a fuzing mechanism located at the front of the casing causes the warheads to detonate sequentially, starting with the rearmost warhead to the frontmost warhead. U.S. Pat. No. 4,901,645 discloses a projectile having a single penetrator rod that has a plurality of annular grooves. Upon impact, the rod breaks along the grooves, allowing the rod to separate into sections that then separately impact the target in the same location.

One disadvantage of the above described penetrators is that the effectiveness and location of the impact of each impact body, core, warhead or rod section (all referred to as penetrator segments) depends on the impact of the preceding penetrator segment. Because the segments of these penetrators are held closely together up to the point of impact, either by a central rod or by containment within the penetrator, each segment will impact the same location on the target almost immediately after the impact of the preceding segment. If the preceding segment does not fully disintegrate immediately upon impact, then the impact of the next segment will be disrupted by the debris and remnants from the preceding impact. A greater distance between the segments, thereby allowing for a greater amount of time between impacts, would allow each segment to impact the target after the preceding segment has fully disintegrated and the gases and/or remnants of the preceding impact have been exhausted. The above described penetrators do not allow for a significant distance between the segments due to size constraints of the projectile, both for storage and deployment purposes.

Furthermore, because each of the segments in these penetrators is held in axial alignment until impact, these penetrators are constrained to impacting a target at a single location. While sequential impact in a single location can be desirable for penetrating buried and/or multilayered targets, other targets may be more suitably defeated by multiple impacts in several locations. The above described projectiles cannot impact a target at multiple locations, even though the penetrators contain multiple impact segments.

The inventor of the invention claimed herein has previously filed a U.S. patent application Ser. No. 08/699,225, entitled "Penetrator Having Multiple Impact Segments", now U.S. Pat. No. 5,384,684, that is suitable for solving the above-listed problems. Application Ser. No. 08/699,225 discloses a penetrator comprised of a plurality of stacked penetrator segments, including a leading penetrator segment, at least one intermediate penetrator segment, and a trailing penetrator segment, all sequentially positioned along the longitudinal axis of the penetrator. Each penetrator segment has a nose portion and a rear portion. The rear portion of the leading penetrator segment and of each intermediate penetrator segment has a plurality of fins pivotally mounted thereon and a rearwardly opening cavity. The rear portion of the trailing penetrator segment has an enlarged tail. The penetrator segments are stacked along the longitudinal axis of the penetrator such that the rearwardly opening cavity of the leading penetrator segment contains the nose portion of the forwardmost intermediate penetrator segment. Each intermediate penetrator segment is stacked with its nose portion positioned within the rearwardly opening cavity of the immediately preceding penetrator segment. The penetrator segments are further stacked such that the nose portion of the trailing penetrator segment is positioned within the rearwardly opening cavity of the rearmost intermediate penetrator segment.

Each fin on the penetrator segments has a stabilizing portion and a deployment preventing arm. The deployment preventing arm contacts the nose portion of the immediately following penetrator segment when that nose portion is fully inserted into the respective rearwardly opening cavity. The contact between the nose portion and the deployment preventing arm of each fin prevents the fins from pivoting to their deployed positions and causes the fins to be restrained in their stowed positions. When the nose portion withdraws from the rearwardly opening cavity, the contact between the nose portion and the arm of each fin is discontinued, thereby permitting the fins of the penetrator segment to pivot to their deployed positions.

Upon initiating separation of the penetrator segments, aerodynamic drag against the enlarged tail of the trailing penetrator segment causes the velocity of the trailing penetrator segment to decrease with respect to the remaining stacked penetrator segments. The nose portion of the trailing penetrator segment thereby withdraws from the rearwardly opening cavity of the rearmost intermediate penetrator segment and the trailing penetrator segment thus separates from the remaining stacked penetrator segments. The withdrawal of the nose portion of the trailing penetrator segment from the rearwardly opening cavity of the rearmost intermediate penetrator segment permits the fins of the rearmost positioned intermediate penetrator segment to deploy. The stabilizing portions of the deployed fins of the rearmost intermediate penetrator segment produce aerodynamic drag, thus decreasing the velocity of the rearmost intermediate penetrator segment. The nose portion of the rearmost intermediate penetrator segment thereby withdraws from the rearwardly opening cavity of the immediately preceding penetrator segment, which thus permits the fins of the immediately preceding penetrator segment to deploy. The fins of each of the at least one intermediate penetrator segment are similarly allowed to deploy, until the forwardmost intermediate penetrator segment separates from the leading penetrator segment. Thereupon, the penetrator has fully separated into discrete penetrator segments which are aerodynamically stabilized and which can sequentially impact a target. By initiating separation of the penetrator segments at an appropriately short distance from the target, the separated penetrator segments can then impact the target in a collinear manner so that each penetrator segment impacts the target in the same location. Alternatively, by initiating separation of the penetrator segments at a sufficiently long distance from the target, the penetrator segments will disperse due to aerodynamic asymmetries, thereby causing the penetrator segments to impact the target in multiple locations.

While the above-described penetrator is suitable for the penetration and/or destruction of many kinds of targets, it relies only on the kinetic energy from the motion of the penetrator for its destructive effects. To obtain enhanced destructive capacity, it would be desirable to have a weapon that can both penetrate a target and explode upon impact with the outer surface of the target, within the interior of the target, or within a cavity in the target's outer surface. Some targets may also have an outer layer of explosive reactive armor comprised of an explosive layer and a layer of metal plates. Upon impact of the leading segment of a multi-segment penetrator, the explosive element of the armor causes the metal plates to fly apart and interfere with the incoming segments of the same penetrator. Still other types of armor may have cavities or openings intended to defeat an incoming penetrator. It would be desirable to have a penetrator that can defeat these kinds of armor.

SUMMARY OF THE INVENTION

It is an object of the present invention to provide a penetrator capable of impacting a target a multiple number of times. It is a further object of the present invention to provide a penetrator that is capable of sequentially impacting the same location on a target a multiple number of times, or is capable of impacting multiple locations on the same target.

Another object of the present invention is to provide a penetrator capable of separating into multiple segments before impacting a target such that the distance between the separated segments is sufficient to prevent the impact of a preceding segment from adversely affecting the impact of a following segment. It is a further object of the invention that the segments aerodynamically separate during the flight of the penetrator, thus eliminating the requirement of additional components for causing separation of the segments. It is also an object of the invention that the segments be aerodynamically stable during flight. Another object of the present invention is to provide a penetrator that includes an explosive element that can explode upon impact with the outer surface of the target, within the target, and within a cavity in the outer surface of the target created by the impact of preceding penetrator segments.

Another object of the present invention is to provide a penetrator having a stiff flight body that can also easily separate into multiple spaced-apart segments during flight. It is a further object of the present invention to provide a penetrator having a smaller stored length than the fully deployed length upon initiating impact with a target.

The invention is a penetrator comprised of a plurality of stacked penetrator segments, including a leading penetrator segment, at least one intermediate penetrator segment, and a trailing penetrator segment, all sequentially positioned along the longitudinal axis of the penetrator. One or more of the penetrator segments contains an explosive element. Each penetrator segment has a nose portion and a rear portion. The rear portion of the leading penetrator segment and of each intermediate penetrator segment has a plurality of fins pivotally mounted thereon and a rearwardly opening cavity. The rear portion of the trailing penetrator segment has an enlarged tail. The penetrator segments are stacked along the longitudinal axis of the penetrator such that the rearwardly opening cavity of the leading penetrator segment contains the nose portion of the forwardmost intermediate penetrator segment. Each intermediate penetrator segment is stacked with its nose portion positioned within the rearwardly opening cavity of the immediately preceding penetrator segment. The penetrator segments are further stacked such that the nose portion of the trailing penetrator segment is positioned within the rearwardly opening cavity of the rearmost intermediate penetrator segment.

Each fin on the penetrator segments has a stabilizing portion and a deployment preventing arm. The deployment preventing arm contacts the nose portion of the immediately following penetrator segment when that nose portion is fully inserted into the respective rearwardly opening cavity. The contact between the nose portion and the deployment preventing arm of each fin prevents the fins from pivoting to their deployed positions and causes the fins to be restrained in their stowed positions. When the nose portion withdraws from the rearwardly opening cavity, the contact between the nose portion and the arm of each fin is discontinued, thereby permitting the fins of the penetrator segment to pivot to their deployed positions.

Upon initiating separation of the penetrator segments, aerodynamic drag against the enlarged tail of the trailing penetrator segment causes the velocity of the trailing penetrator segment to decrease with respect to the remaining stacked penetrator segments. The nose portion of the trailing penetrator segment thereby withdraws from the rearwardly opening cavity of the rearmost intermediate penetrator segment and the trailing penetrator segment thus separates from the remaining stacked penetrator segments. The withdrawal of the nose portion of the trailing penetrator segment from the rearwardly opening cavity of the rearmost intermediate penetrator segment permits the fins of the rearmost positioned intermediate penetrator segment to deploy. The stabilizing portions of the deployed fins of the rearmost intermediate penetrator segment produce aerodynamic drag, thus decreasing the velocity of the rearmost intermediate penetrator segment. The nose portion of the rearmost intermediate penetrator segment thereby withdraws from the rearwardly opening cavity of the immediately preceding penetrator segment, which thus permits the fins of the immediately preceding penetrator segment to deploy. The fins of each of the at least one intermediate penetrator segment are similarly allowed to deploy, until the forwardmost intermediate penetrator segment separates from the leading penetrator segment. Thereupon, the penetrator has fully separated into discrete penetrator segments which are aerodynamically stabilized and which can sequentially impact a target. One or more of the penetrator segments contains an explosive element.

In one embodiment, the trailing penetrator segment contains an explosive element such that when the trailing penetrator segment impacts the target, the explosive element contained in the trailing penetrator segment explodes. If the preceding penetrator segments have fully penetrated the target, the trailing penetrator segment will enter the interior of the target, thereby allowing the explosive element to explode within the target. Alternatively, if the preceding penetrator segments have only partially penetrated the target, the trailing penetrator segment will enter a cavity in the outer surface of the target created by the impact of the preceding segments, and the explosive element will explode in such cavity.

In another embodiment, the leading penetrator segment contains an explosive element. When the leading penetrator segment impacts a target, the explosive element explodes, thereby defeating or weakening the outer surface of the target so that the destructive effect of the following penetrator segments is enhanced. If the target has an outer layer of explosive reactive armor, the leading penetrator segment will defeat such armor upon impact and prevent the armor from interfering with the impact of the following segments. In addition, one or more of the intermediate penetrator segments may contain an explosive element that explodes upon impact with the target to thereby enhance the destructive capability of the penetrator or defeat armor containing cavities designed to defeat penetrators.

DETAILED DESCRIPTION

Figure 1:
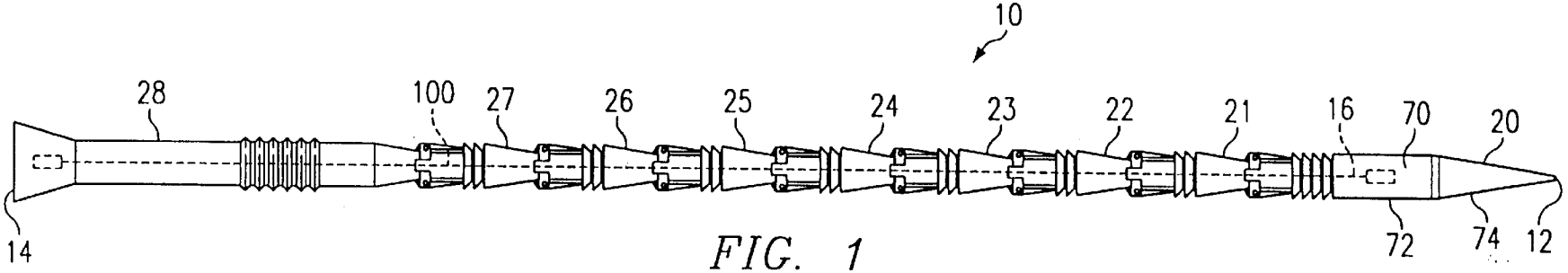
FIG. 1 is a side view of a penetrator according to a first embodiment of the present invention, the penetrator having a plurality of stacked penetrator segments with the trailing penetrator segment containing an explosive element.

FIG. 1 shows a penetrator 10 having a leading end 12, a trailing end 14, and a longitudinal axis 16 extending between the ends 12 and 14. The penetrator 10 is comprised of a plurality of stacked penetrator segments 20–28, including a leading penetrator segment 20, seven intermediate penetrator segments 21–27, and a trailing penetrator segment 28.

Figure 2B:
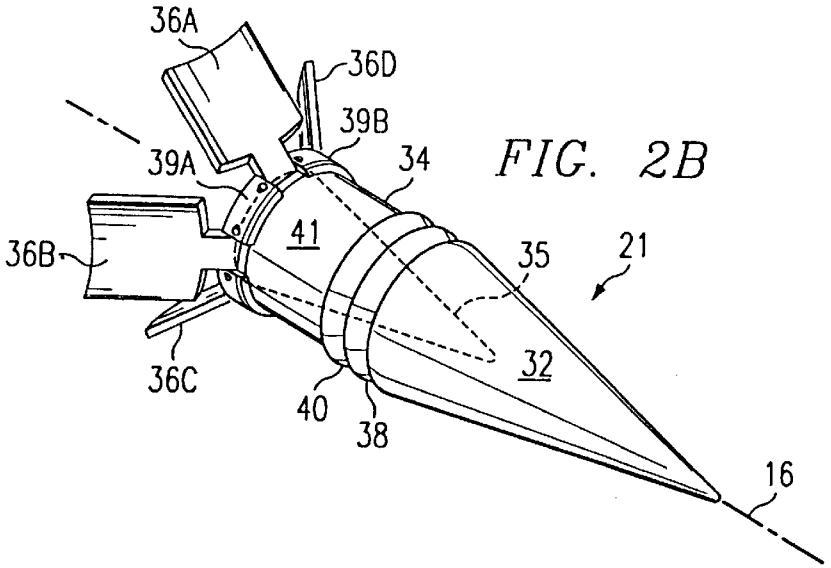
FIG. 2B is a perspective view of a penetrator segment having fins in a deployed position.
Figure 2A:
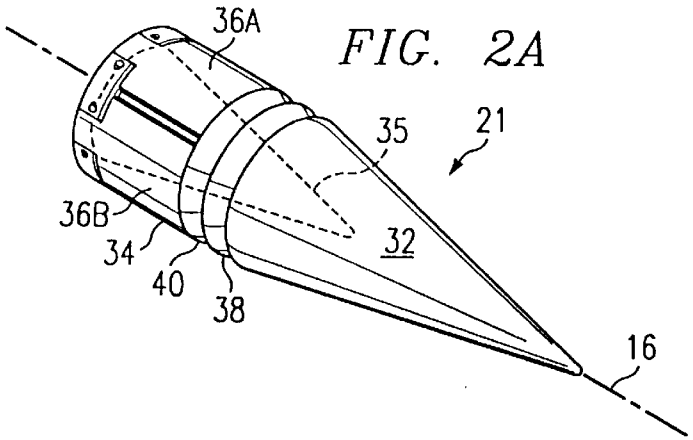
FIG. 2A is a perspective view of a penetrator segment having fins in a stowed position.

FIG. 2A shows a representative individual intermediate penetrator segment, for example, intermediate penetrator segment 21, in a stowed configuration. The intermediate penetrator segment 21 has a nose portion 32 and a rear portion 34. Preferably, the exterior surface of the nose portion 32 is tapered in shape. The nose portion 32 shown in FIG. 2A is substantially in the shape of a right circular cone which is coaxial with longitudinal axis 16, but other suitable tapered shapes may be used as well. The rear portion 34 is preferably at least substantially in the shape of a right circular cylinder which is also coaxial with longitudinal axis 16. The rear portion 34 further has a rearwardly opening cavity 35 which is shown by a dashed line in FIG. 2A. The rearwardly opening cavity 35 is preferably tapered in shape so as to be able to accommodate and to be complementary to the tapered shape of a nose portion of another penetrator segment. Each of four fins 36A–36D (only 36A and 36B being visible in FIG. 2A) is pivotally mounted to the rear portion 34 so that the fins extend forwardly therefrom when in their stowed positions. The fins 36A–36D are shown in their stowed positions wherein the fins 36A–36D are laid alongside the rear portion 34 of the penetrator segment 21 with the longitudinal axis of each fin being at least substantially parallel to the longitudinal axis 16.

Optional grooves 38 and 40, located between the nose portion 32 and the rear portion 34, allow for the penetrator 10 to be encompassed by a sabot (not shown in these figures). A sabot can be used to facilitate the firing of the penetrator 10 from a launch tube, for example, by conforming the outer shape and size of the penetrator 10, including the sabot, to the shape and size of the launch tube. Upon firing the penetrator 10 from the launch tube, the sabot would break apart and fall away from the penetrator 10.

FIG. 2B shows the penetrator segment 21 with its fins 36A–36D in a deployed position. As can be seen in FIG. 2B with the fins in their deployed position, a section 41 of the rear portion 34 has a diameter that is sufficiently smaller than the maximum diameter of the nose portion 32 so that the section 41 of the rear portion 34 can accommodate the fins 36A–36D such that when they are in the stowed position they do not significantly protrude radially outwardly beyond the maximum diameter of the nose portion 32. The fins 36A–36D preferably have a curved shape so as to lay smoothly against the curved surface of section 41 of the rear portion 34.

Figure 3:
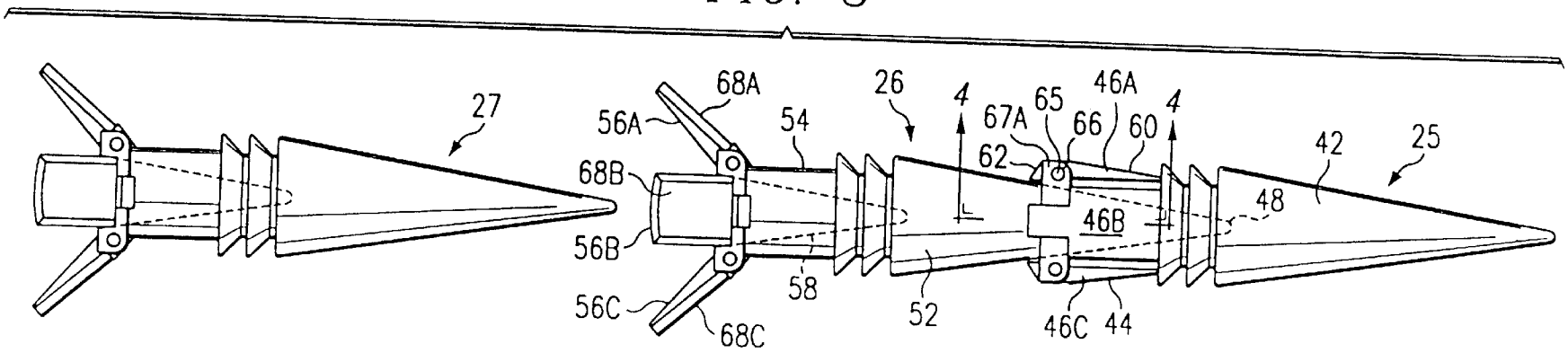
FIG. 3 is a side view of three penetrator segments in a partially deployed configuration.

FIG. 3 shows an intermediate stage in the deployment of the penetrator 10 wherein two intermediate penetrator segments, for example intermediate penetrator segments 25 and 26, are still in the stacked configuration, and a third intermediate penetrator segment 27 has separated from the penetrator segment 26. Like penetrator segment 21 described in FIG. 2A, penetrator segment 25 has a nose portion 42, a rear portion 44, fins 46A–46D (46D not visible) in the stowed position and a rearwardly opening cavity 48. Similarly, the penetrator segment 26 has a nose portion 52, a rear portion 54, fins 56A–56D (56D not visible) in the deployed position, and a rearwardly opening cavity 58. The nose portion 52 of the penetrator segment 26 is still positioned within the rearwardly opening cavity 48 of the penetrator segment 25, so that the penetrator segments 26 and 25 are stacked.

Figure 4:
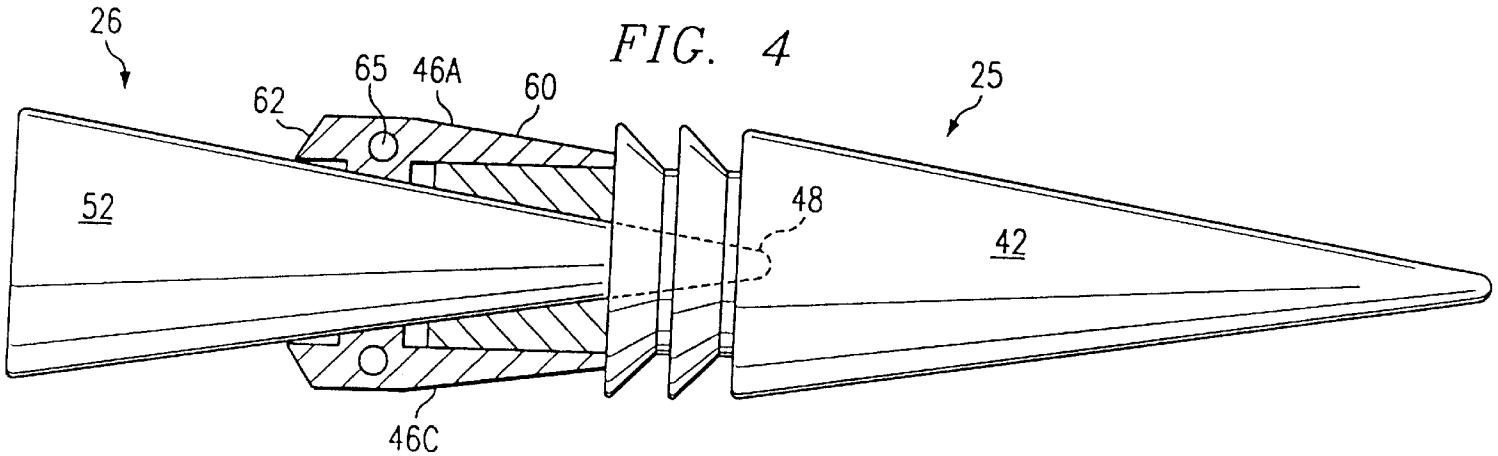
FIG. 4 is a cross-sectional view of a fin in its stowed position and contacting the nose portion of a penetrator segment.

Each fin, for example fin 46A, has a stabilizing portion 60 and a deployment preventing arm 62 on opposite sides of a pivot pin 65. The pivot pin 65 runs through a pinhole 66 in the fin 46A and is mounted between two bosses 67A and 67B positioned on either side of the fin 46A (only boss 67A is visible; see also bosses 39A and 39B in FIG. 2B). Pivot pin 65 is preferably located in a plane which is perpendicular to the longitudinal axis 16. FIG. 4 shows a cross sectional view of fin 46A in its stowed position. The stabilizing portion 60 and the deployment preventing arm 62 are positioned on opposite sides of pivot pin 65 around which the stabilizing portion 60 and the deployment preventing arm 62 can rotate. The deployment preventing arm 62 of the fin 46A is shown contacting the nose portion 52 of the intermediate penetrator segment 26. The contact of the arm 62 with the nose portion 52 prevents the fin 46A from pivoting in an outward direction, thus the fin 46A is restrained in a stowed position with the longitudinal axis of the fin 46A being substantially parallel to the longitudinal axis 16. When the nose portion 52 of penetrator segment 26 is positioned within the rearwardly opening cavity 48 of the penetrator segment 25, arm 62 contacts the nose portion 52 of the penetrator segment 25, causing the fin 46A to remain forwardly pivoted about pivot pin 65 thereby restraining the fin 46A in a stowed position. In contrast, because the penetrator segment 27 shown in FIG. 3 is not positioned in the rearwardly opening cavity 58 of the penetrator segment 26, the fins 56A–56D are free to pivot to their deployed positions wherein the longitudinal axis of each fin 56A–56D is at an angle to the longitudinal axis 16. When the fins 56A–56D are in their deployed positions, the stabilizing portions 68A–68D (68D not visible) of these fins 56A–56D facilitates the aerodynamic stability of the penetrator segment 26 during flight.

The deployment of the fins is preferably accomplished by aerodynamic forces acting on the stabilizing portions of the fins. Alternatively, deployment may be caused by a suitable mechanism such as by springs bearing the fins toward their deployed position. While four fins have been illustrated for each penetrator segment other than the trailing penetrator segment 28, any suitable number of fins can be employed.

Referring again to the penetrator 10 shown in FIG. 1, the penetrator 10 is formed of stacked penetrator segments 20–28. While penetrator 10 is shown to have nine penetrator segments, the penetrator may have any suitable number of penetrator segments, with the potential for destroying a target increasing as more segments are used. Preferably, in order for the penetrator 10 to be rigid, the shape of each nose portion, such as nose portion 52, is complementary to the shape of each rearwardly opening cavity, such as cavity 48 so that there is no play or such that there is slight interference between the stacked penetrator segments 20–28. In addition, the shape of each nose portion and each rearwardly opening cavity should be suitably selected to allow the penetrator segments 20–28 to separate due to aerodynamic forces generated upon deployment of the penetrator 10. Optionally, the nose portions and rearwardly opening cavities may be shaped such that there is a press-fit between the nose portion and rearwardly opening cavity of each pair of adjacent penetrator segments. In such an embodiment, a device such as an explosive, is located between each penetrator segment for overcoming the press-fit between the pair of adjacent penetrator segments at a suitable time after deployment of the penetrator.

Figure 5:
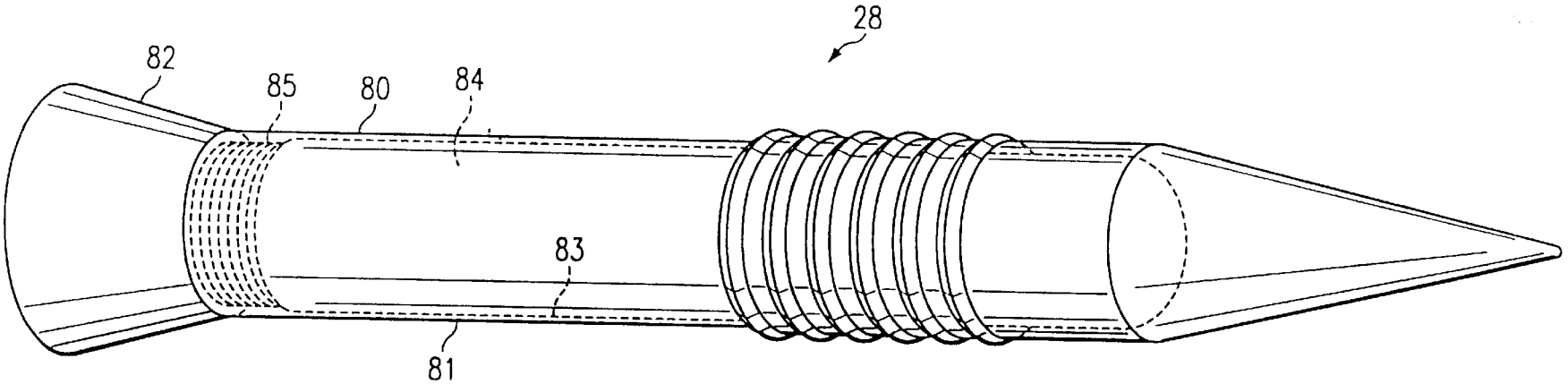
FIG. 5 is a perspective view of a trailing penetrator segment containing an explosive element.

The plurality of stacked penetrator segments 20–28 includes a leading penetrator segment 20 and a trailing penetrator segment 28 which preferably have slightly different characteristics than the intermediate penetrator segments 21–27 as described with respect to FIGS. 2A–B, 3 and 4. In particular, the leading penetrator segment 20 preferably has an elongated nose portion 70 that has a cylindrically shaped base 72 and a tapered tip 74. As shown in FIG. 5, the trailing penetrator segment 28 preferably has an elongated rear portion 80 that has a cylindrically shaped base 81 and an enlarged tail portion 82 that can provide aerodynamic stability to the penetrator 10 before initiation of separation of the penetrator segments. The enlarged tail portion 82 is preferably in the form of a frustoconical shape which expands outwardly from front to rear, but can also be in any other suitable shape or in the form of a plurality of fins. In one embodiment of the invention, the cylindrically shaped base 81 of the penetrator segment 28 has a cavity 83 therein for containing an explosive element 84. The explosive element 84 is preferably comprised of a material that will detonate upon impact, for example, HMX, RDX, PETN, octol or TNT. Alternatively, the explosive element 84 could be detonated by the initiation of a pyrotechnic charge or a time-to-go fuse. Preferably, approximately one pound of explosive material is used, but the amount of explosive will depend on the size of the trailing penetrator segment 28 and how much of the trailing penetrator segment 28 can be dedicated to containing the explosive element 84. The enlarged tail portion 82 has a threaded portion 85 such that the tail portion 82 is threadably attached to the cylindrically shaped base 81. Thus, when the enlarged tail portion 82 is disattached from the cylindrically shaped base 81, the explosive element 84 can be applied to the cavity 83. The explosive element 84 is preferably initially in a liquid state such that it can be poured into the cavity 83 and then allowed to solidify. Alternatively, the explosive element 84 may be initially in a granulated or powdered state and may be pressed into the cavity 83. The enlarged tail portion 82 then threadably attaches to the cylindrically shaped base 81 to thereby seal the cavity 83 with the explosive element 84 contained therein.

Figure 6A:
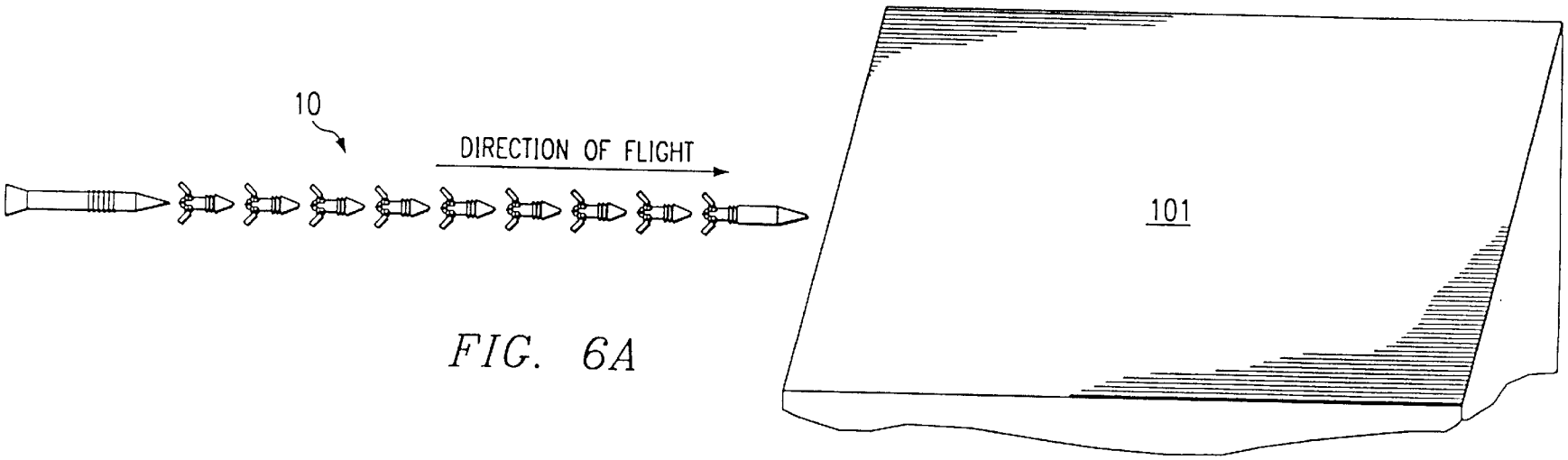
FIG. 6A is a side view of a fully deployed penetrator according to an embodiment of the present invention, wherein the trailing penetrator contains an explosive element, prior to impact with a target.

When the penetrator 10 is launched, such as by firing it from a launch tube, aerodynamic drag against the tail portion 82 causes the velocity of the trailing penetrator segment 28 to decrease with respect to the other stacked penetrator segments 20–27 and, thus, the trailing penetrator segment 28 separates from the stacked penetrator segments 20–27. When the nose portion of the trailing penetrator segment 28 withdraws from the rearwardly opening cavity of the immediately preceding intermediate penetrator segment, i.e., the rearmost intermediate penetrator segment 27, the nose portion of the trailing penetrator segment 28 no longer contacts the deployment preventing arms of the fins of the penetrator segment 27. The flow of air across penetrator segment 27 thereby forces the fins of penetrator segment 27 to pivot to their deployed positions. When the fins of the penetrator segment 27 have pivoted to their deployed positions, aerodynamic drag against these fins causes the velocity of the penetrator segment 27 to decrease with respect to the remaining stacked penetrator segments 20–26. Thus, the penetrator segment 27 separates from penetrator segment 26 which then becomes the rearmost penetrator segment of the stacked penetrator segments 20–26. When the nose portion of the penetrator segment 27 withdraws from the rearwardly opening cavity of penetrator segment 26, the nose portion of the penetrator segment 27 no longer contacts the deployment preventing arms of the fins of the penetrator segment 26. The flow of air across penetrator segment 26 thereby forces the fins of penetrator segment 26 to pivot to their deployed positions. FIG. 3 is representative of the configuration of penetrator segments 27, 26 and 25 after penetrator 27 has separated from the stacked penetrator segments 20–26. Penetrator segment 27 is shown with its fins in their deployed positions and separated from penetrator segment 26. Because the fins of penetrator segment 26 have deployed, aerodynamic drag will cause penetrator segment 26 to begin separating from penetrator segment 25. Similarly, the remaining stacked penetrator segments 20–25 will each separate from the rearmost intermediate penetrator segment in the stack forwardly until intermediate penetrator segment 21 withdraws from the leading penetrator segment 20. FIG. 6A shows the penetrator 10 in a fully deployed configuration wherein all of the penetrator segments 20–28 have separated from each other. Notably, the length of the penetrator 10 in the stacked configuration shown in FIG. 1 is less than, and preferably significantly less than, the length of the penetrator in its fully deployed configuration after the penetrator segments 20–28 have separated from each other.

Optionally, the penetrator segments 20–28 can be joined in the stacked configuration shown in FIG. 1 by a releasable securing member 100, which runs along the longitudinal axis 16 of the penetrator 10 and through axially aligned bores in the penetrator segments 20–28 (axial bores not shown). The securing member 100 can be a rod, wire or cord, for example. A release mechanism, such as a time-to-go-fuse or explosive bolt, can be used to release the securing member 100 so that the penetrator segments 20–28 can separate from each other. The securing member 100 can serve to enhance the rigidity of the penetrator 10 before the penetrator segments 20–28 begin to separate and to control the time during the flight of the penetrator 10 at which the penetrator segments 20–28 begin to separate.

If the securing member 100 is released early in the flight of the penetrator 10 and at a suitably large distance from the intended target, then asymmetric aerodynamic forces acting upon the penetrator segments 20–28 after separation can cause the penetrator segments 20–28 to scatter slightly so that the penetrator segments 20–28 impact the target in multiple locations. In contrast, if the securing member 100 is released late in the flight of the penetrator and at a suitably close distance to an intended target, then the penetrator segments 20–28 will be substantially axially aligned upon impacting the target so that the penetrator segments 20–28 will sequentially impact the target in substantially the same location. Thus, when the penetrator 10 impacts an intended target, the penetrator segments 20–28 are separated from each other, and the distance between the penetrator segments 20–28 (the amount of separation between immediately adjacent penetrator segments) can be controlled through the use of securing member 100.

Figure 6B:
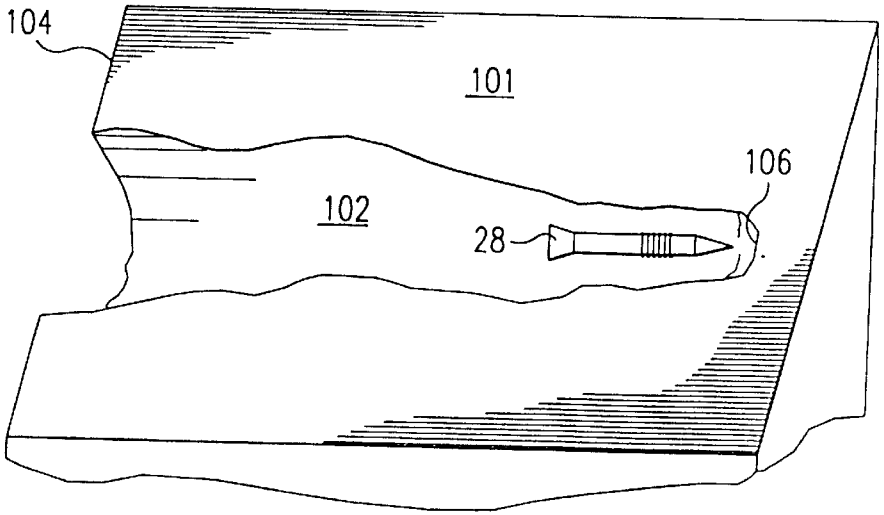
FIG. 6B is a side view of the target after it has been impacted by all of the segments of a penetrator according to an embodiment of the present invention, wherein the trailing penetrator contains an explosive element, but before the explosive element contained in the trailing penetrator segment has exploded.

In an embodiment wherein the trailing penetrator segment 28 contains an explosive element, preferably the securing member 100 is released such that the penetrator segments 20–28 impact the target in substantially the same location so that the explosive element 84 contained in the trailing penetrator segment 28 explodes either inside the target or inside a large cavity in the outer surface of the target. FIG. 6B shows a target 101 that has been impacted by penetrator segments 20–27, which have caused the formation of a cavity 102 in the outer surface 104 of the target. The cavity 102 is bounded by a back surface 106, whose location is determined by the effectiveness of the impact by penetrator segments 20–27. In FIG. 6B, the trailing penetrator segment 28 is shown located within the cavity 102 but prior to its impact with the back surface 106 of the cavity 102. The impact of the trailing penetrator segment 28 with the back surface 106 will cause the explosive element 84 to explode within the cavity 102. Because this explosion will occur in a confined space, and because the remainder of the target's outer surface (if any) in front of the trailing penetrator segment will be weakened by the impact of segments 20–28, and because the bulk of the detonation gases is still moving forward with substantially its original energy and momentum, the effect of the explosion will be much greater than would occur if the explosive element 84 exploded at the outer surface 104 of the target 101. The explosion will have different effects depending on the composition of the target 101; for example, if the target 101 is metallic, then spallation and perforation are enhanced. If the target 101 is ceramic, additional effects can occur, such as shock induced cracking throughout large areas of the target, thereby weakening the overall effectiveness of the target, particularly against subsequent impacts. If the target 101 contains any reactive elements, then the explosion may cause sympathetic detonation of those reactive elements as well. The impact of the penetrator segments 20–27 may also fully penetrate the outer surface 104 of the target 101. In such a case, the trailing penetrator segment 28 will enter the interior of the target 101 and impact a back wall of the target 101 or other objects within the target 101. Upon such impact, the explosive element 84 will explode.

Figure 7:
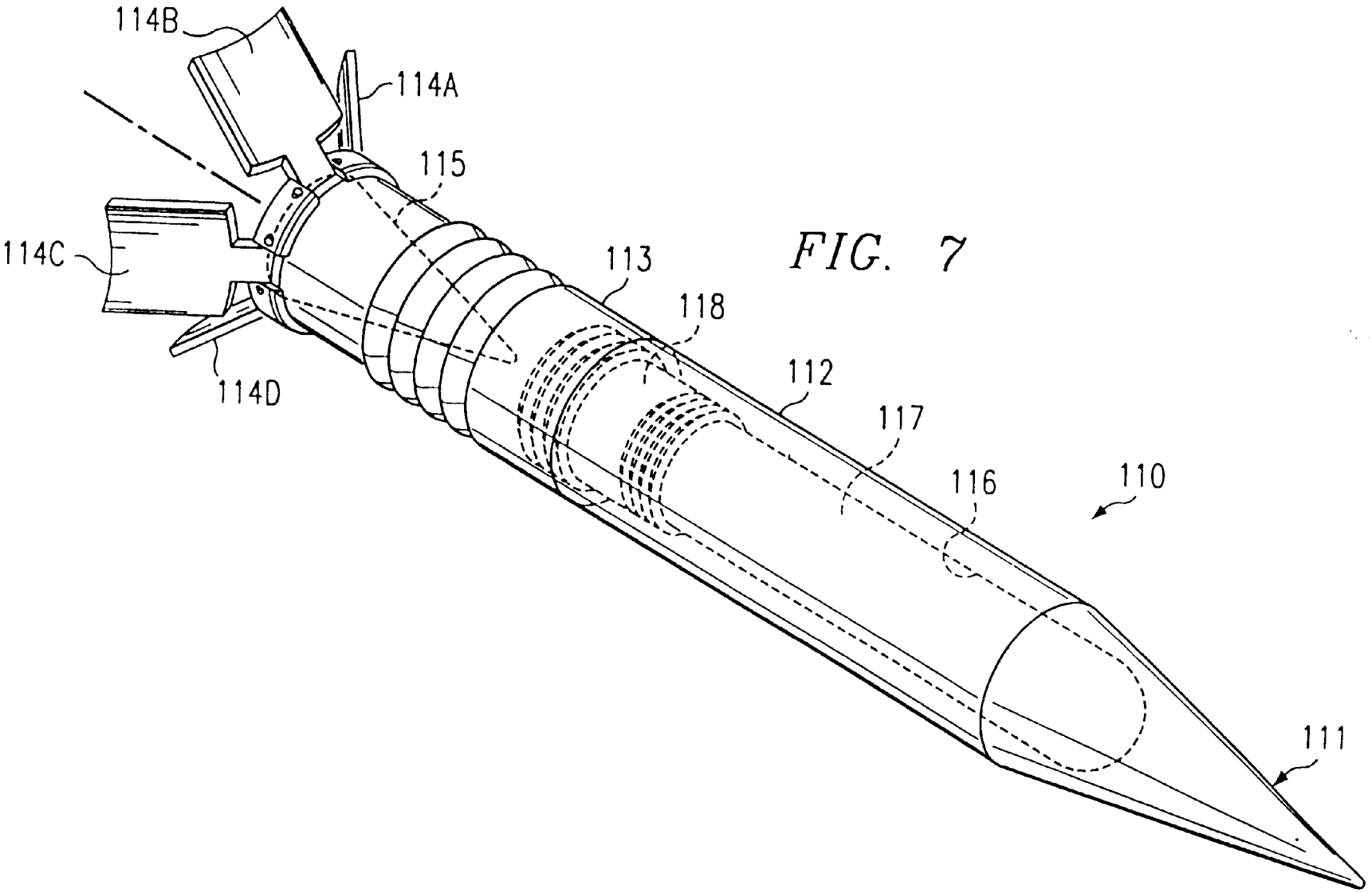
FIG. 7 is a perspective view of a leading penetrator segment according to a second embodiment of the present invention, wherein the leading penetrator segment contains an explosive element.

In an alternative embodiment, the leading penetrator segment contains an explosive element. FIG. 7 shows such a leading penetrator segment 110, which is shaped differently from the leading penetrator segment 20 shown in FIG. 1 in order to contain an explosive element therein. The leading penetrator segment 110 has a nose portion 111 an elongated body portion 112, and a rear portion 113. Similar to the segment 21 as described with respect to FIGS. 2A and 2B, the rear portion 113 has fins 114A–114D pivotally mounted thereon and a rearwardly opening cavity 115 therein. The leading penetrator segment also has a cavity 116 therein for containing an explosive element 117. The explosive element 117 is preferably comprised of a material that will detonate upon impact, for example, HMX, RDX, PETN, octol or TNT. Alternatively, the explosive element 117 could be detonated by the initiation of a pyrotechnic charge or a time-to-go fuse. Preferably, approximately one half kilogram of explosive material is used, but the amount of explosive will depend on the size of the leading penetrator segment 110 and how much of the leading penetrator segment 110 can be dedicated to containing the explosive element 117. The outer walls of one end of the cavity 116 are threaded to receive a threaded plug 118 which thereby seals the explosive element 117 within the cavity 116. The tail end of the elongated body portion 112 is also threaded such that the rear portion 113 threadably attaches to the elongated body portion 112. Thus, the explosive element 117 can be applied to the cavity 116 when the rear portion 113 is disattached from the elongated body portion 112, and the plug 118 is disattached from the cavity 116. The explosive element 117 is preferably initially in a liquid state such that it can be poured into the cavity 116 and then allowed to solidify. Alternatively, the explosive element 117 may initially be in a granulated or powdered state and may be pressed into the cavity 116. The plug 118 can then be applied to the cavity 116 and the tail portion 113 then threadably attached to the elongated body portion 112 so that the leading penetrator segment 110 is fully assembled.

In an embodiment wherein the leading penetrator segment contains an explosive element, the explosive element will explode upon the leading penetrator segment's impact with the outer surface of a target. Depending on the strength of the explosion and the type of target, the explosion will defeat the outer surface of the target, thereby allowing the following penetrator segments to impact the interior of the target, or it will form a crater in the outer surface of the target, the crater being impacted by the following penetrator segments. In such an embodiment, the penetrator segments preferably separate such that explosion of the explosive material contained within the leading penetrator segment and any debris caused by the explosion do not interfere with the flight of the following penetrator segments. At the same time, the distance between the following penetrator segments is preferably sufficiently small such that the impact of the following penetrator segments is in the same area impacted by the leading penetrator segment. This embodiment is particularly effective when the target has explosive reactive armor. The explosion upon impact by the leading penetrator segment will defeat this type of armor and cause deployment of the metal plates of the armor prior to the impact or approach of the following penetrator segments, thereby enhancing the destructive effect of the following penetrator segments.

In another embodiment, one or more of the intermediate penetrator segments contains an explosive element. In order to accommodate the explosive, an intermediate penetrator segment containing an explosive element is shaped differently from the intermediate penetrator segments 21–27 shown in FIG. 1. Instead, a penetrator segment such as the segment 110 shown in FIG. 7 can be used for an intermediate penetrator segment containing an explosive element.

In an embodiment wherein one or more of the intermediate penetrator segments contains an explosive element, the explosive element or elements will explode upon impact of the associated intermediate penetrator segment. If the preceding penetrator segment or segments has penetrated the outer surface of the target, the explosion will occur inside the target. Alternatively, if the preceding penetrator segment or segments have only created a crater in the outer surface of the target, the explosion will either defeat the outer surface of the target or create a larger crater, thereby enhancing the destructive capability of the following penetrator segments. Preferably the following penetrator segments are sufficiently separated from a penetrator segment containing an explosive element such that the explosion and any debris caused by the explosion do not interfere with the flight of the following penetrator segments.

In addition to the above described embodiments, it will be appreciated that any various combination of penetrator segments containing explosive elements may be employed. For example, explosive elements may be contained in both the leading penetrator segment and trailing penetrator segment as well as in one or more of the intermediate penetrator segments.

Reasonable other variations and modifications of the above described penetrator are possible within the scope of the foregoing description, the drawings, and the appended claims to the invention.

What is claimed is:

1. A penetrator for impacting a target, said penetrator having a leading end, a trailing end, and a longitudinal axis extending between said leading end and said trailing end, said penetrator comprising:

a plurality of penetrator segments positioned in axial alignment with each other along the longitudinal axis of said penetrator to form a stack, each of said penetrator segments having a nose portion and a rear portion, said plurality of penetrator segments including a leading penetrator segment, at least one intermediate penetrator segment, and a trailing penetrator segment;

said leading penetrator segment being positioned at the leading end of said penetrator, the rear portion of said leading penetrator segment having a rearwardly opening cavity therein, the rearwardly opening cavity being shaped to receive a nose portion of a forwardmost one of said at least one intermediate penetrator segment;

the rear portion of each of said at least one intermediate penetrator segment having a rearwardly opening cavity therein, the rearwardly opening cavity of each of said at least one intermediate penetrator segment being shaped to receive a nose portion of an immediately rearwardly positioned penetrator segment, the rear portion of each of said at least one intermediate penetrator segment having a plurality of fins pivotally mounted thereon, each of the fins having a stowed position and a deployed position, the nose portion of each of said at least one intermediate penetrator segment being positioned within the rearwardly opening cavity of an immediately preceding penetrator segment; and said trailing penetrator segment being positioned such that said at least one intermediate penetrator segment is located between said leading penetrator segment and said trailing penetrator segment, the nose portion of said trailing penetrator segment being positioned in the rearwardly opening cavity of a rearmost one of said at least one intermediate penetrator segment such that the nose portion of said trailing penetrator segment engages an element associated with each of said fins of the rearmost one of said at least one intermediate penetrator segment to thereby prevent the fins of the rearmost one of said at least one intermediate penetrator segment from pivoting from their stowed positions to their deployed positions, the rear portion of said trailing penetrator segment having a tail portion, said trailing penetrator segment having an explosive element contained therein;

whereby upon initiation of deployment of said penetrator, aerodynamic drag against the tail portion of said trailing penetrator segment decreases the velocity of said trailing penetrator segment, thereby causing said trailing penetrator segment to withdraw from the rearwardly opening cavity of the rearmost one of said at least one intermediate penetrator segment, whereupon the fins of the rearmost one of said at least one intermediate penetrator segment pivot from their stowed positions to their deployed positions; whereupon aerodynamic drag against the thus deployed fins of the rearmost one of said at least one intermediate penetrator segment decreases the velocity of the rearmost one of said at least one intermediate penetrator segment; and when the fins of the forwardmost one of said at least one intermediate penetrator segment are in their deployed positions, aerodynamic drag against the fins of the forwardmost one of said at least one intermediate penetrator segment decreases the velocity of the forwardmost one of said at least one intermediate penetrator segment, thereby causing said forwardmost one of said at least one intermediate penetrator segment to withdraw from the rearwardly opening cavity of the leading penetrator segment; whereupon said plurality of penetrator segments have aerodynamically separated from each other and each penetrator segment can separately impact the target in sequence and the explosive element contained within said trailing penetrator segment can explode.

2. A penetrator in accordance with claim 1, wherein each of said fins has a stabilizing portion and a deployment preventing arm, said stabilizing portion and said deployment preventing arm being positioned about a pivot, such that when the nose portion of a rear penetrator segment of a pair of immediately adjacent penetrator segments is positioned in the rearwardly opening cavity of a front penetrator segment of the respective pair of immediately adjacent penetrator segments, the nose portion of the rear penetrator segment of the respective pair contacts the deployment preventing arms of the fins of the front penetrator segment of the respective pair so as to prevent the fins of the front penetrator segment of the respective pair from pivoting from their stowed positions to their deployed positions; and such that when the nose portion of the rear penetrator segment of the respective pair withdraws from the rearwardly opening cavity of the front penetrator segment of the respective pair, the nose portion of the rear penetrator segment of the respective pair disengages from contacting the deployment preventing arms of the fins of the front penetrator segment of the respective pair, thereby permitting the fins of the front penetrator segment of the respective pair to pivot from their stowed positions to their deployed positions, whereupon aerodynamic drag against the stabilizing portions of the fins of the front penetrator segment of the respective pair can decrease the velocity of the front penetrator segment of the respective pair.

3. A penetrator in accordance with claim 1, wherein the nose portion of each of said plurality of penetrator segments has a tapered shape.

4. A penetrator in accordance with claim 3, wherein the rearwardly opening cavity of each of said at least one intermediate penetrator segment and of said leading penetrator segment has a tapered shape so as to be complementary to the nose portion of the immediately rearwardly positioned penetrator segment.

5. A penetrator in accordance with claim 1, wherein said penetrator further comprises:

a releasable securing member extending along the longitudinal axis of said penetrator, said securing member securing said plurality of penetrator segments in axial alignment with each other in a stacked configuration until a predetermined time after launching of said penetrator; and a release mechanism for releasing said securing member at a predetermined time after launching of said penetrator;

whereby said plurality of penetrator segments are secured in axial alignment with each other in a stacked configuration until said release mechanism releases said securing member, thereby permitting said plurality of penetrator segments to aerodynamically separate.

6. A penetrator in accordance with claim 1, wherein the target has an exterior surface, and wherein each penetrator segment impacts the exterior surface of the target to thereby create a cavity in the exterior surface of the target so that the explosive element can explode in the cavity in the exterior surface of the target.

7. A penetrator in accordance with claim 1, wherein the target has an exterior surface and an interior, and wherein each penetrator segment impacts the exterior surface of the target to thereby create a passageway in the exterior surface to the interior of the target so that the explosive element can explode in the interior of the target.

8. A penetrator in accordance with claim 1, wherein the impact of said trailing penetrator segment with the target causes the explosive element contained within said trailing penetrator segment to explode.

9. A penetrator in accordance with claim 1, wherein when the fins of said at least one intermediate penetrator segment are in their stowed positions, each fin of said at least one intermediate penetrator segment has an aerodynamic surface which is exposed to air flow, wherein air flow across the aerodynamic surfaces of the fins of said at least one intermediate penetrator segment subsequent to launching of said penetrator causes the fins of said at least one intermediate penetrator segment to open to their deployed positions.

10. A penetrator in accordance with claim 1, wherein the rear portion of each of said at least one intermediate penetrator segment has at least four fins.

11. A penetrator in accordance with claim 1, wherein the fins of each one of said at least one intermediate penetrator segment are mounted around the circumference of the rear portion of the respective intermediate penetrator segment, each fin being pivotally mounted to the rear portion of the respective intermediate penetrator segment by at least one pivot pin, each of said at least one pivot pin being in a plane that is generally perpendicular to the longitudinal axis of said penetrator.

12. A penetrator in accordance with claim 1, wherein said penetrator has at least four penetrator segments.

13. A penetrator in accordance with claim 1, wherein said penetrator has at least eight penetrator segments.

14. A penetrator in accordance with claim 1, wherein the rear portion of each of said at least one intermediate penetrator segment has a diameter that is less than the maximum diameter of the nose portion of the respective intermediate penetrator segment, whereby when the fins of the respective intermediate penetrator segment are in their stowed positions, they do not protrude radially outwardly beyond the maximum diameter of the nose portion of the respective intermediate penetrator segment.

15. A penetrator in accordance with claim 1, wherein each of the fins of said at least one intermediate penetrator segment has a longitudinal axis, whereby when the fins of said at least one intermediate penetrator segment are in their stowed positions, the longitudinal axis of each of the fins of said at least one intermediate penetrator segment is generally parallel to the longitudinal axis of said penetrator, and when the fins of said at least one intermediate penetrator segment are in their deployed positions, the longitudinal axis of each of the thus deployed fins of said at least one intermediate penetrator segment is at an angle to the longitudinal axis of said penetrator.

16. A penetrator for impacting a target, said penetrator having a leading end, a trailing end, and a longitudinal axis extending between said leading end and said trailing end, said penetrator comprising:

a plurality of penetrator segments positioned in axial alignment along the longitudinal axis of said penetrator to form a stack, each of said penetrator segments having a tapered nose portion and a generally cylindrical rear portion, said plurality of penetrator segments including a leading penetrator segment, at least one intermediate penetrator segment, and a trailing penetrator segment;

said leading penetrator segment being positioned at the leading end of said penetrator, the rear portion of said leading penetrator segment having a rearwardly opening cavity therein, the rearwardly opening cavity being tapered in shape and shaped to receive a nose portion of a forwardmost one of said at least one intermediate penetrator segment;

the rear portion of each of said at least one intermediate penetrator segment having a rearwardly opening cavity therein, the rearwardly opening cavity of each of said at least one intermediate penetrator segment being tapered in shape and shaped to receive a nose portion of an immediately rearwardly positioned penetrator segment, the nose portion of each of said at least one intermediate penetrator segment being positioned within the rearwardly opening cavity of an immediately preceding penetrator segment, each of said at least one intermediate penetrator segment having a plurality of fins pivotally mounted around the circumference of the rear portion of the respective intermediate penetrator segment, each of said fins being pivotally mounted by a pivot pin positioned through a pinhole in the fin and supported by two bosses positioned adjacent to opposing sides of the fin, said pivot pin and said pinhole being in a plane that is perpendicular to the longitudinal axis of said penetrator; each of said fins having a longitudinal axis, a stabilizing portion, and a deployment preventing arm; said stabilizing portion and said deployment preventing arm being located about the pivot pin positioned through the respective fin, each of said fins having a stowed position wherein the longitudinal axis of the respective fin is generally parallel to the longitudinal axis of said penetrator, and a deployed position wherein the longitudinal axis of the thus deployed respective fin is at an angle to the longitudinal axis of said penetrator;

whereby when the nose portion of a rear penetrator segment of a pair of immediately adjacent penetrator segments is positioned within the rearwardly opening cavity of a front penetrator segment of the respective pair of immediately adjacent penetrator segments, the nose portion of the rear penetrator segment of the respective pair contacts the deployment preventing arms of the fins of the front penetrator segment of the respective pair, thereby preventing the fins of the front penetrator segment of the respective pair from pivoting from their stowed positions to their deployed positions, and whereby when the nose portion of the rear penetrator segment of the respective pair is not positioned in the rearwardly opening cavity of the front penetrator segment of the respective pair, the nose portion of the rear penetrator segment of the respective pair does not contact the deployment preventing arms of the fins of the front penetrator segment of the respective pair, thereby permitting the fins of the front penetrator segment of the respective pair to pivot from their stowed positions to their deployed positions;

said trailing penetrator segment being positioned such that said at least one intermediate penetrator segment is located between said leading penetrator segment and said trailing penetrator segment, the nose portion of said trailing penetrator segment being positioned in the rearwardly opening cavity of a rearmost one of said at least one intermediate penetrator segment, the nose portion of said trailing penetrator segment contacting the deployment preventing arms of the fins of the rearmost one of said at least one intermediate penetrator segment, thereby preventing the fins of the rearmost one of said at least one intermediate penetrator segment from pivoting from their stowed positions to their deployed positions the rear portion of said trailing penetrator segment having an enlarged tail portion, said trailing penetrator segment having an explosive element contained therein;

a releasable securing member extending along the longitudinal axis of said penetrator, said securing member securing said plurality of penetrator segments in axial alignment with each other in a stacked configuration until a predetermined time after launching of said penetrator; and a release mechanism for releasing said securing member at a predetermined time after launching of said penetrator, whereby said plurality of penetrator segments are secured in axial alignment in a stacked configuration until said release mechanism releases said securing member;

whereby upon launching said penetrator and after said release mechanism releases said securing member, aerodynamic drag against the enlarged tail portion of said trailing penetrator segment decreases the velocity of said trailing penetrator segment, thereby causing said trailing penetrator segment to withdraw from the rearwardly opening cavity of the rearmost one of said at least one intermediate penetrator segment, thereby permitting the fins of the rearmost one of said at least one intermediate penetrator segment to pivot from their stowed positions to their deployed positions; whereupon aerodynamic drag against the thus deployed fins of the rearmost one of said at least one intermediate penetrator segment decreases the velocity of the rearmost one of said at least one intermediate penetrator segment; and upon deployment of the fins of the forwardmost one of said at least one intermediate penetrator segment, aerodynamic drag against the thus deployed fins of the forwardmost one of said at least one intermediate penetrator segment decreases the velocity of the forwardmost one of said at least one intermediate penetrator segment, thereby causing the nose portion of the forwardmost one of said at least one intermediate penetrator segment to withdraw from the rearwardly opening cavity of the leading penetrator segment; whereupon said plurality of penetrator segments have aerodynamically separated from each other and each penetrator segment can separately impact the target in sequence and without being adversely affected by the impact of any preceding penetrator segments and the explosive element contained within said trailing penetrator segment can explode.

17. A penetrator in accordance with claim 16, wherein the target has an exterior surface, and wherein each penetrator segment impacts the exterior surface of the target to thereby create a cavity in the exterior surface of the target so that the explosive element can explode in the cavity in the exterior surface of the target.

18. A penetrator in accordance with claim 16, wherein the target has an exterior surface and an interior, and wherein each penetrator segment impacts the exterior surface of the target to thereby create a passageway in the exterior surface to the interior of the target so that the explosive element can explode in the interior of the target.

19. A penetrator in accordance with claim 16, wherein the impact of said trailing penetrator segment with the target causes the explosive element contained within said trailing penetrator segment to explode.

20. A penetrator for impacting a target, said penetrator having a leading end, a trailing end and a longitudinal axis extending between said leading end and said trailing end, said penetrator comprising:

a first penetrator segment positioned in axial alignment with the longitudinal axis of said penetrator, said first penetrator segment having a tail portion and a nose portion, said first penetrator segment having an explosive element contained therein; and a second penetrator segment positioned in axial alignment with said first penetrator segment, said second penetrator segment being immediately adjacent to and preceding said first penetrator segment, said second penetrator segment having a rearwardly opening cavity shaped to receive the nose portion of said first penetrator segment, said second penetrator segment further having a plurality of fins pivotally mounted thereon, each of said fins having a stowed position and a deployed position, the nose portion of said first penetrator segment being initially positioned in the rearwardly opening cavity of said second penetrator segment such that the nose portion of said first penetrator segment engages an element associated with each of said fins of said second penetrator segment to thereby prevent the fins of said second penetrator segment from pivoting from their stowed positions to their deployed positions;

whereby upon initiation of deployment of said penetrator, aerodynamic drag against the tail portion of said first penetrator segment causes the velocity of said first penetrator segment to decrease with respect to the velocity of said second penetrator segment, whereupon the nose of said first penetrator segment withdraws from the rearwardly opening cavity of said second penetrator segment, whereupon the fins of said second penetrator segment pivot from their stowed positions to their deployed positions, whereupon said first and second penetrator segments have separated from each other and each of said first and second penetrator segments can separately impact the target in sequence and the explosive element contained within said first penetrator segment can explode.

21. A penetrator in accordance with claim 20, wherein each of the fins of said second penetrator segment has a stabilizing portion and a deployment preventing arm, said stabilizing portion and said deployment preventing arm positioned about a pivot; whereby when the nose portion of said first penetrator segment is positioned in the rearwardly opening cavity of said second penetrator segment, the nose portion of said first penetrator segment contacts the deployment preventing arms of the fins of said second penetrator segment, thereby preventing the fins of the second penetrator segment from pivoting from their stowed positions to their deployed positions; and whereby when the nose portion of said first penetrator segment withdraws from the rearwardly opening cavity of said second penetrator segment, the nose portion of said first penetrator segment no longer contacts the deployment preventing arms of the fins of said second penetrator segment, thereby permitting the fins of said second penetrator segment to pivot from their stowed positions to their deployed positions.

22. A penetrator in accordance with claim 20, wherein the nose portion of said first penetrator segment has a tapered shape.

23. A penetrator in accordance with claim 22, wherein the rearwardly opening cavity of said second penetrator segment has a tapered shape so as to be complementary to the nose portion of said first penetrator segment.

24. A penetrator in accordance with claim 20, wherein said penetrator further comprises:

a releasable securing member extending along the longitudinal axis of said penetrator, said securing member securing said first and second penetrator segments in axial alignment with each other and adjacent to each other until a predetermined time after launching of said penetrator; and a release mechanism for releasing said securing member at a predetermined time after launching of said penetrator;

whereby said first and second penetrator segments are secured in axial alignment with each other and adjacent to each other until said release mechanism releases said securing member, thereby permitting said first and second penetrator segments to aerodynamically separate.

25. A penetrator in accordance with claim 20, wherein the target has an exterior surface, and wherein said first and second penetrator segments impact the exterior surface of the target to thereby create a cavity in the exterior surface of the target so that the explosive element can explode in the cavity in the exterior surface of the target.

26. A penetrator in accordance with claim 20, wherein the target has an exterior surface and an interior, and wherein said first penetrator segment impacts the exterior surface of the target to thereby create a passageway in the exterior surface to the interior of the target so that said first penetrator segment impacts the interior of the target and the explosive element can explode in the interior of the target.

27. A penetrator in accordance with claim 20, wherein the impact of said first penetrator segment with the target causes the explosive element contained within said first penetrator segment to explode.

28. A penetrator in accordance with claim 20, wherein said second penetrator segment has at least four fins.

29. A penetrator in accordance with claim 20, wherein said second penetrator segment has a tapered nose portion and a cylindrical rear portion, with the fins of said second penetrator segment being mounted around the circumference of the rear portion of said second penetrator segment, with each fin being pivotally mounted to the second penetrator segment by at least one pivot pin, each of said at least one pivot pin being in a plane that is generally perpendicular to the longitudinal axis of said penetrator.

30. A penetrator in accordance with claim 29, wherein the diameter of the rear portion of said second penetrator segment is smaller than the maximum diameter of said nose portion of said second penetrator segment, whereby when the fins of said second penetrator segment are in their stowed positions, the fins do not protrude radially outwardly beyond the maximum diameter of the nose portion of said second penetrator segment.

31. A penetrator in accordance with claim 20, wherein each of the fins of said second penetrator segment has a longitudinal axis, whereby when the fins of said second penetrator segment are in their stowed positions, the longitudinal axis of each fin of said second penetrator segment is generally parallel to the longitudinal axis of said penetrator, and when the fins of said second penetrator segment are in their deployed positions, the longitudinal axis of each of the thus deployed fins of said second penetrator segment is at an angle to the longitudinal axis of said penetrator segment.

32. A penetrator for impacting a target, said penetrator having a leading end, a trailing end, and a longitudinal axis extending between said leading end and said trailing end, said penetrator comprising:

a plurality of penetrator segments positioned in axial alignment with each other along the longitudinal axis of said penetrator to form a stack, one or more of said penetrator segments containing an explosive element, each of said penetrator segments having a nose portion and a rear portion, said plurality of penetrator segments including a leading penetrator segment, at least one intermediate penetrator segment, and a trailing penetrator segment;

said leading penetrator segment being positioned at the leading end of said penetrator, the rear portion of said leading penetrator segment having a rearwardly opening cavity therein, the rearwardly opening cavity being shaped to receive a nose portion of a forwardmost one of said at least one intermediate penetrator segment;

the rear portion of each of said at least one intermediate penetrator segment having a rearwardly opening cavity therein, the rearwardly opening cavity of each of said at least one intermediate penetrator segment being shaped to receive a nose portion of an immediately rearwardly positioned penetrator segment, the rear portion of each of said at least one intermediate penetrator segment having a plurality of fins pivotally mounted thereon, each of the fins having a stowed position and a deployed position, the nose portion of each of said at least one intermediate penetrator segment being positioned within the rearwardly opening cavity of an immediately preceding penetrator segment; and said trailing penetrator segment being positioned such that said at least one intermediate penetrator segment is located between said leading penetrator segment and said trailing penetrator segment, the nose portion of said trailing penetrator segment being positioned in the rearwardly opening cavity of a rearmost one of said at least one intermediate penetrator segment such that the nose portion of said trailing penetrator segment engages an element associated with each of the fins of said at least one intermediate penetrator segment to thereby prevent the fins of the rearmost one of said at least one intermediate penetrator segment from pivoting from their stowed positions to their deployed positions, the rear portion of said trailing penetrator segment having a tail portion;

whereby upon initiation of deployment of said penetrator, aerodynamic drag against the tail portion of said trailing penetrator segment decreases the velocity of said trailing penetrator segment, thereby causing said trailing penetrator segment to withdraw from the rearwardly opening cavity of the rearmost one of said at least one intermediate penetrator segment, whereupon the fins of the rearmost one of said at least one intermediate penetrator segment can pivot from their stowed positions to their deployed positions; whereupon aerodynamic drag against the thus deployed fins of the rearmost one of said at least one intermediate penetrator segment decreases the velocity of the rearmost one of said at least one intermediate penetrator segment; and when the fins of the forwardmost one of said at least one intermediate penetrator segment are in their deployed positions, aerodynamic drag against the fins of the forwardmost one of said at least one intermediate penetrator segment decreases the velocity of the forwardmost one of said at least one intermediate penetrator segment, thereby causing said forwardmost one of said at least one intermediate penetrator segment to withdraw from the rearwardly opening cavity of the leading penetrator segment; whereupon said plurality of penetrator segments have aerodynamically separated from each other and each penetrator segment can separately impact the target in sequence and the explosive element contained within one or more of said penetrator segments can explode.

33. A penetrator in accordance with claim 32, wherein each of said fins has a stabilizing portion and a deployment preventing arm, said stabilizing portion and said deployment preventing arm being positioned about a pivot, such that when the nose portion of a rear penetrator segment of a pair of immediately adjacent penetrator segments is positioned in the rearwardly opening cavity of a front penetrator segment of the respective pair of immediately adjacent penetrator segments, the nose portion of the rear penetrator segment of the respective pair contacts the deployment preventing arms of the fins of the front penetrator segment of the respective pair so as to prevent the fins of the front penetrator segment of the respective pair from pivoting from their stowed positions to their deployed positions; and such that when the nose portion of the rear penetrator segment of the respective pair withdraws from the rearwardly opening cavity of the front penetrator segment of the respective pair, the nose portion of the rear penetrator segment of the respective pair disengages from contacting the deployment preventing arms of the fins of the front penetrator segment of the respective pair, thereby permitting the fins of the front penetrator segment of the respective pair to pivot from their stowed positions to their deployed positions, whereupon aerodynamic drag against the stabilizing portions of the fins of the front penetrator segment of the respective pair can decrease the velocity of the front penetrator segment of the respective pair.

34. A penetrator in accordance with claim 32, wherein the nose portion of each of said plurality of penetrator segments has a tapered shape.

35. A penetrator in accordance with claim 34, wherein the rearwardly opening cavity of each of said at least one intermediate penetrator segment and of said leading penetrator segment has a tapered shape so as to be complementary to the nose portion of the immediately rearwardly positioned penetrator segment.

36. A penetrator in accordance with claim 32, wherein said penetrator further comprises:

a releasable securing member extending along the longitudinal axis of said penetrator, said securing member securing said plurality of penetrator segments in axial alignment with each other in a stacked configuration until a predetermined time after launching of said penetrator, and a release mechanism for releasing said securing member at a predetermined time after launching of said penetrator;

whereby said plurality of penetrator segments are secured in axial alignment with each other in a stacked configuration until said release mechanism releases said securing member, thereby permitting said plurality of penetrator segments to aerodynamically separate.

37. A penetrator in accordance with claim 32, wherein when the fins of said at least one intermediate penetrator segment are in their stowed positions, each fin of said at least one intermediate penetrator segment has an aerodynamic surface which is exposed to air flow, wherein air flow across the aerodynamic surfaces of the fins of said at least one intermediate penetrator segment subsequent to launching of said penetrator causes the fins of said at least one intermediate penetrator segment to open to their deployed positions.

38. A penetrator in accordance with claim 32, wherein the rear portion of each of said at least one intermediate penetrator segment has at least four fins.

39. A penetrator in accordance with claim 32, wherein the fins of each one of said at least one intermediate penetrator segment are mounted around the circumference of the rear portion of the respective intermediate penetrator segment, each fin being pivotally mounted to the rear portion of the respective intermediate penetrator segment by at least one pivot pin, each of said at least one pivot pin being in a plane that is generally perpendicular to the longitudinal axis of said penetrator.

40. A penetrator in accordance with claim 32, wherein said penetrator has at least four penetrator segments.

41. A penetrator in accordance with claim 32, wherein said penetrator has at least eight penetrator segments.

42. A penetrator in accordance with claim 32, wherein the rear portion of each of said at least one intermediate penetrator segment has a diameter that is less than the maximum diameter of the nose portion of the respective intermediate penetrator segment, whereby when the fins of the respective intermediate penetrator segment are in their stowed positions, they do not protrude radially outwardly beyond the maximum diameter of the nose portion of the respective intermediate penetrator segment.

43. A penetrator in accordance with claim 32, wherein each of the fins of said at least one intermediate penetrator segment has a longitudinal axis, whereby when the fins of said at least one intermediate penetrator segment are in their stowed positions, the longitudinal axis of each of the fins of said at least one intermediate penetrator segment is generally parallel to the longitudinal axis of said penetrator, and when the fins of said at least one intermediate penetrator segment are in their deployed positions, the longitudinal axis of each of the thus deployed fins of said at least one intermediate penetrator segment is at an angle to the longitudinal axis of said penetrator.

44. A penetrator in accordance with claim 32, wherein said trailing penetrator segment contains an explosive element.

45. A penetrator in accordance with claim 44, wherein the target has an exterior surface, and wherein each penetrator segment impacts the exterior surface of the target to thereby create a cavity in the exterior surface of the target so that the explosive element contained in said trailing penetrator segment can explode in the cavity in the exterior surface of the target.

46. A penetrator in accordance with claim 44, wherein the target has an exterior surface and an interior, and wherein each penetrator segment impacts the exterior surface of the target to thereby create a passageway in the exterior surface to the interior of the target so that the explosive element contained in said trailing penetrator segment can explode in the interior of the target.

47. A penetrator in accordance with claim 44, wherein the impact of said trailing penetrator segment with the target causes the explosive element contained within said trailing penetrator segment to explode.

48. A penetrator in accordance with claim 44, wherein said trailing penetrator segment contains a time-to-go fuse for initiating the explosion of said explosive element contained with said trailing penetrator segment.

49. A penetrator in accordance with claim 32, wherein said leading penetrator segment contains an explosive element.

50. A penetrator in accordance with claim 49, wherein the impact of said leading penetrator segment with the target causes the explosive element contained within said leading penetrator segment to explode.

51. A penetrator in accordance with claim 49, wherein said leading penetrator segment contains a time-to-go fuse for initiating the explosion of said explosive element contained in said leading penetrator segment.

52. A penetrator in accordance with claim 32, wherein at least one of said at least one intermediate penetrator segment contains an explosive element.

53. A penetrator in accordance with claim 52, wherein the impact of said at least one intermediate penetrator segment with the target causes the explosive element contained in at least one of said at least one intermediate penetrator segment to explode.

54. A penetrator in accordance with claim 52, wherein the at least one of said at least one intermediate penetrator segment that contains an explosive element also contains a time-to-go fuse for initiating the explosion of said explosive element.

55. A penetrator for impacting a target, said penetrator having a leading end, a trailing end, and a longitudinal axis extending between said leading end and said trailing end, said penetrator comprising:

a plurality of penetrator segments positioned in axial alignment along the longitudinal axis of said penetrator to form a stack, one or more of said penetrator segments containing an explosive element, each of said penetrator segments having a tapered nose portion and a generally cylindrical rear portion, said plurality of penetrator segments including a leading penetrator segment, at least one intermediate penetrator segment, and a trailing penetrator segment;

said leading penetrator segment being positioned at the leading end of said penetrator, the rear portion of said leading penetrator segment having a rearwardly opening cavity therein, the rearwardly opening cavity being tapered in shape and shaped to receive a nose portion of a forwardmost one of said at least one intermediate penetrator segment;

the rear portion of each of said at least one intermediate penetrator segment having a rearwardly opening cavity therein, the rearwardly opening cavity of each of said at least one intermediate penetrator segment being tapered in shape and shaped to receive a nose portion of an immediately rearwardly positioned penetrator segment, the nose portion of each of said at least one intermediate penetrator segment being positioned within the rearwardly opening cavity of an immediately preceding penetrator segment, each of said at least one intermediate penetrator segment having a plurality of fins pivotally mounted around the circumference of the rear portion of the respective intermediate penetrator segment, each of said fins being pivotally mounted by a pivot pin positioned through a pinhole in the fin and supported by two bosses positioned adjacent to opposing sides of the fin, said pivot pin and said pinhole being in a plane that is perpendicular to the longitudinal axis of said penetrator; each of said fins having a longitudinal axis, a stabilizing portion, and a deployment preventing arm; said stabilizing portion and said deployment preventing arm being located about the pivot pin positioned through the respective fin, each of said fins having a stowed position wherein the longitudinal axis of the respective fin is generally parallel to the longitudinal axis of said penetrator, and a deployed position wherein the longitudinal axis of the thus deployed respective fin is at an angle to the longitudinal axis of said penetrator;

whereby when the nose portion of a rear penetrator segment of a pair of immediately adjacent penetrator segments is positioned within the rearwardly opening cavity of a front penetrator segment of the respective pair of immediately adjacent penetrator segments, the nose portion of the rear penetrator segment of the respective pair contacts the deployment preventing arms of the fins of the front penetrator segment of the respective pair, thereby preventing the fins of the front penetrator segment of the respective pair from pivoting from their stowed positions to their deployed positions, and whereby when the nose portion of the rear penetrator segment of the respective pair is not positioned in the rearwardly opening cavity of the front penetrator segment of the respective pair, the nose portion of the rear penetrator segment of the respective pair does not contact the deployment preventing arms of the fins of the front penetrator segment of the respective pair, thereby permitting the fins of the front penetrator segment of the respective pair to pivot from their stowed positions to their deployed positions;

said trailing penetrator segment being positioned such that said at least one intermediate penetrator segment is located between said leading penetrator segment and said trailing penetrator segment, the nose portion of said trailing penetrator segment being positioned in the rearwardly opening cavity of a rearmost one of said at least one intermediate penetrator segment, the nose portion of said trailing penetrator segment contacting the deployment preventing arms of the fins of the rearmost one of said at least one intermediate penetrator segment, thereby preventing the fins of the rearmost one of said at least one intermediate penetrator segment from pivoting from their stowed positions to their deployed positions, the rear portion of said trailing penetrator segment having an enlarged tail portion;

a releasable securing member extending along the longitudinal axis of said penetrator, said securing member securing said plurality of penetrator segments in axial alignment with each other in a stacked configuration until a predetermined time after launching of said penetrator; and a release mechanism for releasing said securing member at a predetermined time after launching of said penetrator, whereby said plurality of penetrator segments are secured in axial alignment in a stacked configuration until said release mechanism releases said securing member;

whereby upon launching said penetrator and after said release mechanism releases said securing member, aerodynamic drag against the enlarged tail portion of said trailing penetrator segment decreases the velocity of said trailing penetrator segment, thereby causing said trailing penetrator segment to withdraw from the rearwardly opening cavity of the rearmost one of said at least one intermediate penetrator segment, thereby permitting the fins of the rearmost one of said at least one intermediate penetrator segment to pivot from their stowed positions to their deployed positions; whereupon aerodynamic drag against the thus deployed fins of the rearmost one of said at least one intermediate penetrator segment decreases the velocity of the rearmost one of said at least one intermediate penetrator segment; and upon deployment of the fins of the forwardmost one of said at least one intermediate penetrator segment, aerodynamic drag against the thus deployed fins of the forwardmost one of said at least one intermediate penetrator segment decreases the velocity of the forwardmost one of said at least one intermediate penetrator segment, thereby causing the nose portion of the forwardmost one of said at least one intermediate penetrator segment to withdraw from the rearwardly opening cavity of the leading penetrator segment; whereupon said plurality of penetrator segments have aerodynamically separated from each other and each penetrator segment can separately impact the target in sequence and without being adversely affected by the impact of any preceding penetrator segments and the explosive element contained within one or more of said penetrator segments can explode.

56. A penetrator in accordance with claim 55, wherein said trailing penetrator segment contains an explosive element.

57. A penetrator in accordance with claim 56, wherein the target has an exterior surface, and wherein each penetrator segment impacts the exterior surface of the target to thereby create a cavity in the exterior surface of the target so that the explosive element contained in said trailing penetrator segment can explode in the cavity in the exterior surface of the target.

58. A penetrator in accordance with claim 56, wherein the target has an exterior surface and an interior, and wherein each penetrator segment impacts the exterior surface of the target to thereby create a passageway in the exterior surface to the interior of the target so that the explosive element contained in said trailing penetrator segment can explode in the interior of the target.

59. A penetrator in accordance with claim 56, wherein the impact of said trailing penetrator segment with the target causes the explosive element contained within said trailing penetrator segment to explode.

60. A penetrator in accordance with claim 56, wherein said trailing penetrator segment contains a time-to-go fuse for initiating the explosion of said explosive element contained in said trailing penetrator segment.

61. A penetrator in accordance with claim 55, wherein said leading penetrator segment contains an explosive element.

62. A penetrator in accordance with claim 61, wherein the impact of said leading penetrator segment with the target causes the explosive element contained within said leading penetrator segment to explode.

63. A penetrator in accordance with claim 61, wherein said leading penetrator segment contains a time-to-go fuse for initiating the explosion of said explosive element contained in said leading penetrator segment.

64. A penetrator in accordance with claim 55, wherein at least one of said at least one intermediate penetrator segment contains an explosive element.

65. A penetrator in accordance with claim 64, wherein the impact of said at least one intermediate penetrator segment with the target causes the explosive element contained in at least one of said at least one intermediate penetrator segment to explode.

66. A penetrator in accordance with claim 64, wherein said at least one intermediate penetrator segment that contains an explosive element also contains a time-to-go fuse for initiating the explosion of said explosive element.

67. A penetrator for impacting a target, said penetrator having a leading end, a trailing end and a longitudinal axis extending between said leading end and said trailing end, said penetrator comprising:

a first penetrator segment positioned in axial alignment with the longitudinal axis of said penetrator, said first penetrator segment having a tail portion and a nose portion; and a second penetrator segment positioned in axial alignment with said first penetrator segment, said second penetrator segment having an explosive element contained therein, said second penetrator segment being immediately adjacent to and preceding said first penetrator segment, said second penetrator segment having a rearwardly opening cavity shaped to receive the nose portion of said first penetrator segment, said second penetrator segment further having a plurality of fins pivotally mounted thereon, each of said fins having a stowed position and a deployed position, the nose portion of said first penetrator segment being initially positioned in the rearwardly opening cavity of said second penetrator segment such that the nose portion of said first penetrator segment engages an element associated with each of the fins of said second penetrator segment to thereby prevent the fins of said second penetrator segment from pivoting from their stowed positions to their deployed positions;

whereby upon initiation of deployment of said penetrator, aerodynamic drag against the tail portion of said first penetrator segment causes the velocity of said first penetrator segment to decrease with respect to the velocity of said second penetrator segment, whereupon the nose portion of said first penetrator segment withdraws from the rearwardly opening cavity of said second penetrator segment, thereby permitting the fins of said second penetrator segment to pivot from their stowed positions to their deployed positions, whereupon said first and second penetrator segments have separated from each other and each of said first and second penetrator segments can separately impact the target in sequence and the explosive element contained within said second penetrator segment can explode.

68. A penetrator in accordance with claim 67, wherein each of the fins of said second penetrator segment has a stabilizing portion and a deployment preventing arm, said stabilizing portion and said deployment preventing arm positioned about a pivot; whereby when the nose portion of said first penetrator segment is positioned in the rearwardly opening cavity of said second penetrator segment, the nose portion of said first penetrator segment contacts the deployment preventing arms of the fins of said second penetrator segment, thereby preventing the fins of the second penetrator segment from pivoting from their stowed positions to their deployed positions; and whereby when the nose portion of said first penetrator segment withdraws from the rearwardly opening cavity of said second penetrator segment, the nose portion of said first penetrator segment no longer contacts the deployment preventing arms of the fins of said second penetrator segment, thereby permitting the fins of said second penetrator segment to pivot from their stowed positions to their deployed positions.

69. A penetrator in accordance with claim 68, wherein the nose portion of said first penetrator segment has a tapered shape.

70. A penetrator in accordance with claim 69, wherein the rearwardly opening cavity of said second penetrator segment has a tapered shape so as to be complementary to the nose portion of said first penetrator segment.

71. A penetrator in accordance with claim 67, wherein said penetrator further comprises:

a releasable securing member extending along the longitudinal axis of said penetrator, said securing member securing said first and second penetrator segments in axial alignment with each other and adjacent to each other until a predetermined time after launching of said penetrator; and a release mechanism for releasing said securing member at a predetermined time after launching of said penetrator;

whereby said first and second penetrator segments are secured in axial alignment with each other and adjacent to each other until said release mechanism releases said securing member, thereby permitting said first and second penetrator segments to aerodynamically separate.

72. A penetrator in accordance with claim 67, wherein the impact of said second penetrator segment with the target causes the explosive element contained within said second penetrator segment to explode.

73. A penetrator in accordance with claim 67, wherein said second penetrator segment contains a time-to-go fuse for initiating the explosion of said explosive element contained in said second penetrator segment.

74. A penetrator in accordance with claim 67, wherein said second penetrator segment has at least four fins.

75. A penetrator in accordance with claim 67, wherein said second penetrator segment has a tapered nose portion and a cylindrical rear portion, with the fins of said second penetrator segment being mounted around the circumference of the rear portion of said second penetrator segment, with each fin being pivotally mounted to the second penetrator segment by at least one pivot pin, each of said at least one pivot pin being in a plane that is generally perpendicular to the longitudinal axis of said penetrator.

76. A penetrator in accordance with claim 75, wherein the diameter of the rear portion of said second penetrator segment is smaller than the maximum diameter of said nose portion of said second penetrator segment, whereby when the fins of said second penetrator segment are in their stowed positions, the fins do not protrude radially outwardly beyond the maximum diameter of the nose portion of said second penetrator segment.

77. A penetrator in accordance with claim 67, wherein each of the fins of said second penetrator segment has a longitudinal axis, whereby when the fins of said second penetrator segment are in their stowed positions, the longitudinal axis of each fin of said second penetrator segment is generally parallel to the longitudinal axis of said penetrator, and when the fins of said second penetrator segment are in their deployed positions, the longitudinal axis of each of the thus deployed fins of said second penetrator segment is at an angle to the longitudinal axis of said penetrator segment.

78. A penetrator in accordance with claim 67, wherein said first penetrator segment has an explosive element contained therein.

79. A penetrator in accordance with claim 78, wherein the impact of said first penetrator segment with the target causes the explosive element contained within said first penetrator segment to explode.

80. A penetrator in accordance with claim 78, wherein said first penetrator segment contains a time-to-go fuse for initiating the explosion of said explosive element contained with said first penetrator segment.

81. A penetrator for impacting a target, said penetrator having a leading end, a trailing end, and a longitudinal axis extending between said leading end and said trailing end, said penetrator comprising:

a plurality of penetrator segments positioned in axial alignment with each other along the longitudinal axis of said penetrator to form a stack, each of said penetrator segments having a nose portion and a rear portion, said plurality of penetrator segments including a leading penetrator segment, at least one intermediate penetrator segment, and a trailing penetrator segment;

said leading penetrator segment being positioned at the leading end of said penetrator, the rear portion of said leading penetrator segment having a rearwardly opening cavity therein, the rearwardly opening cavity being shaped to receive a nose portion of a forwardmost one of said at least one intermediate penetrator segment, said leading penetrator segment having an explosive element contained therein;

the rear portion of each of said at least one intermediate penetrator segment having a rearwardly opening cavity therein, the rearwardly opening cavity of each of said at least one intermediate penetrator segment being shaped to receive a nose portion of an immediately rearwardly positioned penetrator segment, the rear portion of each of said at least one intermediate penetrator segment having a plurality of fins pivotally mounted thereon, each of the fins having a stowed position and a deployed position, the nose portion of each of said at least one intermediate penetrator segment being positioned within the rearwardly opening cavity of an immediately preceding penetrator segment; and said trailing penetrator segment being positioned such that said at least one intermediate penetrator segment is located between said leading penetrator segment and said trailing penetrator segment, the nose portion of said trailing penetrator segment being positioned in the rearwardly opening cavity of a rearmost one of said at least one intermediate penetrator segment such that the nose portion of said trailing penetrator segment engages an element associated with each of the fins of said at least one intermediate penetrator segment to thereby prevent the fins of the rearmost one of said at least one intermediate penetrator segment from pivoting from their stowed positions to their deployed positions, the rear portion of said trailing penetrator segment having a tail portion;

whereby upon initiation of deployment of said penetrator, aerodynamic drag against the tail portion of said trailing penetrator segment decreases the velocity of said trailing penetrator segment, thereby causing said trailing penetrator segment to withdraw from the rearwardly opening cavity of the rearmost one of said at least one intermediate penetrator segment, whereupon the fins of the rearmost one of said at least one intermediate penetrator segment can pivot from their stowed positions to their deployed positions; whereupon aerodynamic drag against the thus deployed fins of the rearmost one of said at least one intermediate penetrator segment decreases the velocity of the rearmost one of said at least one intermediate penetrator segment; and when the fins of the forwardmost one of said at least one intermediate penetrator segment are in their deployed positions, aerodynamic drag against the fins of the forwardmost one of said at least one intermediate penetrator segment decreases the velocity of the forwardmost one of said at least one intermediate penetrator segment, thereby causing said forwardmost one of said at least one intermediate penetrator segment to withdraw from the rearwardly opening cavity of the leading penetrator segment; whereupon said plurality of penetrator segments have aerodynamically separated from each other and each penetrator segment can separately impact the target in sequence and the explosive element contained within said leading penetrator segment can explode.

82. A penetrator in accordance with claim 81, wherein each of said fins has a stabilizing portion and a deployment preventing arm, said stabilizing portion and said deployment preventing arm being positioned about a pivot, such that when the nose portion of a rear penetrator segment of a pair of immediately adjacent penetrator segments is positioned in the rearwardly opening cavity of a front penetrator segment of the respective pair of immediately adjacent penetrator segments, the nose portion of the rear penetrator segment of the respective pair contacts the deployment preventing arms of the fins of the front penetrator segment of the respective pair so as to prevent the fins of the front penetrator segment of the respective pair from pivoting from their stowed positions to their deployed positions; and such that when the nose portion of the rear penetrator segment of the respective pair withdraws from the rearwardly opening cavity of the front penetrator segment of the respective pair, the nose portion of the rear penetrator segment of the respective pair disengages from contacting the deployment preventing arms of the fins of the front penetrator segment of the respective pair, thereby permitting the fins of the front penetrator segment of the respective pair to pivot from their stowed positions to their deployed positions, whereupon aerodynamic drag against the stabilizing portions of the fins of the front penetrator segment of the respective pair can decrease the velocity of the front penetrator segment of the respective pair.

83. A penetrator in accordance with claim 81, wherein the nose portion of each of said plurality of penetrator segments has a tapered shape.

84. A penetrator in accordance with claim 83, wherein the rearwardly opening cavity of each of said at least one intermediate penetrator segment and of said leading penetrator segment has a tapered shape so as to be complementary to the nose portion of the immediately rearwardly positioned penetrator segment.

85. A penetrator in accordance with claim 81, wherein said penetrator further comprises:

a releasable securing member extending along the longitudinal axis of said penetrator, said securing member securing said plurality of penetrator segments in axial alignment with each other in a stacked configuration until a predetermined time after launching of said penetrator; and a release mechanism for releasing said securing member at a predetermined time after launching of said penetrator;

whereby said plurality of penetrator segments are secured in axial alignment with each other in a stacked configuration until said release mechanism releases said securing member, thereby permitting said plurality of penetrator segments to aerodynamically separate.

86. A penetrator in accordance with claim 81, wherein the impact of said leading penetrator segment with the target causes the explosive element contained in said leading penetrator segment to explode.

87. A penetrator in accordance with claim 81, wherein said leading penetrator segment contains a time-to-go fuse for initiating the explosion of said explosive element contained within said leading penetrator segment.

88. A penetrator in accordance with claim 81, wherein when the fins of said at least one intermediate penetrator segment are in their stowed positions, each fin of said at least one intermediate penetrator segment has an aerodynamic surface which is exposed to air flow, wherein air flow across the aerodynamic surfaces of the fins of said at least one intermediate penetrator segment subsequent to launching of said penetrator causes the fins of said at least one intermediate penetrator segment to open to their deployed positions.

89. A penetrator in accordance with claim 81, wherein the rear portion of each of said at least one intermediate penetrator segment has at least four fins.

90. A penetrator in accordance with claim 81, wherein the fins of each one of said at least one intermediate penetrator segment are mounted around the circumference of the rear portion of the respective intermediate penetrator segment, each fin being pivotally mounted to the rear portion of the respective intermediate penetrator segment by at least one pivot pin, each of said at least one pivot pin being in a plane that is generally perpendicular to the longitudinal axis of said penetrator.

91. A penetrator in accordance with claim 81, wherein said penetrator has at least four penetrator segments.

92. A penetrator in accordance with claim 81, wherein said penetrator has at least eight penetrator segments.

93. A penetrator in accordance with claim 81, wherein the rear portion of each of said at least one intermediate penetrator segment has a diameter that is less than the maximum diameter of the nose portion of the respective intermediate penetrator segment, whereby when the fins of the respective intermediate penetrator segment are in their stowed positions, they do not protrude radially outwardly beyond the maximum diameter of the nose portion of the respective intermediate penetrator segment.

94. A penetrator in accordance with claim 81, wherein each of the fins of said at least one intermediate penetrator segment has a longitudinal axis, whereby when the fins of said at least one intermediate penetrator segment are in their stowed positions, the longitudinal axis of each of the fins of said at least one intermediate penetrator segment is generally parallel to the longitudinal axis of said penetrator, and when the fins of said at least one intermediate penetrator segment are in their deployed positions, the longitudinal axis of each of the thus deployed fins of said at least one intermediate penetrator segment is at an angle to the longitudinal axis of said penetrator.

95. A penetrator for impacting a target, said penetrator having a leading end, a trailing end, and a longitudinal axis extending between said leading end and said trailing end, said penetrator comprising:

a plurality of penetrator segments positioned in axial alignment with each other along the longitudinal axis of said penetrator to form a stack, each of said penetrator segments having a nose portion and a rear portion, said plurality of penetrator segments including a leading penetrator segment, at least one intermediate penetrator segment, and a trailing penetrator segment;

said leading penetrator segment being positioned at the leading end of said penetrator, the rear portion of said leading penetrator segment having a rearwardly opening cavity therein, the rearwardly opening cavity being shaped to receive a nose portion of a forwardmost one of said at least one intermediate penetrator segment;

the rear portion of each of said at least one intermediate penetrator segment having a rearwardly opening cavity therein, the rearwardly opening cavity of each of said at least one intermediate penetrator segment being shaped to receive a nose portion of an immediately rearwardly positioned penetrator segment, the rear portion of each of said at least one intermediate penetrator segment having a plurality of fins pivotally mounted thereon, each of the fins having a stowed position and a deployed position, the nose portion of each of said at least one intermediate penetrator segment being positioned within the rearwardly opening cavity of an immediately preceding penetrator segment, at least one of said intermediate penetrator segments having an explosive element contained therein; and said trailing penetrator segment being positioned such that said at least one intermediate penetrator segment is located between said leading penetrator segment and said trailing penetrator segment, the nose portion of said trailing penetrator segment being positioned in the rearwardly opening cavity of a rearmost one of said at least one intermediate penetrator segment such that the nose portion of said trailing penetrator segment engages an element associated with each of the fins of said at least one intermediate penetrator segment to thereby prevent the fins of the rearmost one of said at least one intermediate penetrator segment from pivoting from their stowed positions to their deployed positions, the rear portion of said trailing penetrator segment having a tail portion;

whereby upon initiation of deployment of said penetrator, aerodynamic drag against the tail portion of said trailing penetrator segment decreases the velocity of said trailing penetrator segment, thereby causing said trailing penetrator segment to withdraw from the rearwardly opening cavity of the rearmost one of said at least one intermediate penetrator segment, whereupon the fins of the rearmost one of said at least one intermediate penetrator segment can pivot from their stowed positions to their deployed positions; whereupon aerodynamic drag against the thus deployed fins of the rearmost one of said at least one intermediate penetrator segment decreases the velocity of the rearmost one of said at least one intermediate penetrator segment; and when of the fins of the forwardmost one of said at least one intermediate penetrator segment are in their deployed positions, aerodynamic drag against the fins of the forwardmost one of said at least one intermediate penetrator segment decreases the velocity of the forwardmost one of said at least one intermediate penetrator segment, thereby causing said forwardmost one of said at least one intermediate penetrator segment to withdraw from the rearwardly opening cavity of the leading penetrator segment; whereupon said plurality of penetrator segments have aerodynamically separated from each other and each penetrator segment can separately impact the target in sequence and the explosive element contained within at least one of said at least one intermediate penetrator segment can explode.

96. A penetrator in accordance with claim 95, wherein each of said fins has a stabilizing portion and a deployment preventing arm, said stabilizing portion and said deployment preventing arm being positioned about a pivot, such that when the nose portion of a rear penetrator segment of a pair of immediately adjacent penetrator segments is positioned in the rearwardly opening cavity of a front penetrator segment of the respective pair of immediately adjacent penetrator segments, the nose portion of the rear penetrator segment of the respective pair contacts the deployment preventing arms of the fins of the front penetrator segment of the respective pair so as to prevent the fins of the front penetrator segment of the respective pair from pivoting from their stowed positions to their deployed positions; and such that when the nose portion of the rear penetrator segment of the respective pair withdraws from the rearwardly opening cavity of the front penetrator segment of the respective pair, the nose portion of the rear penetrator segment of the respective pair disengages from contacting the deployment preventing arms of the fins of the front penetrator segment of the respective pair, thereby permitting the fins of the front penetrator segment of the respective pair to pivot from their stowed positions to their deployed positions, whereupon aerodynamic drag against the stabilizing portions of the fins of the front penetrator segment of the respective pair can decrease the velocity of the front penetrator segment of the respective pair.

97. A penetrator in accordance with claim 95, wherein the nose portion of each of said plurality of penetrator segments has a tapered shape.

98. A penetrator in accordance with claim 97, wherein the rearwardly opening cavity of each of said at least one intermediate penetrator segment and of said leading penetrator segment has a tapered shape so as to be complementary to the nose portion of the immediately rearwardly positioned penetrator segment.

99. A penetrator in accordance with claim 95, wherein said penetrator further comprises:

a releasable securing member extending along the longitudinal axis of said penetrator, said securing member securing said plurality of penetrator segments in axial alignment with each other in a stacked configuration until a predetermined time after launching of said penetrator; and a release mechanism for releasing said securing member at a predetermined time after launching of said penetrator;

whereby said plurality of penetrator segments are secured in axial alignment with each other in a stacked configuration until said release mechanism releases said securing member, thereby permitting said plurality of penetrator segments to aerodynamically separate.

100. A penetrator in accordance with claim 95, wherein the impact of said at least one intermediate penetrator segment with the target causes the explosive element contained in at least one of said at least one intermediate penetrator segment to explode.

101. A penetrator in accordance with claim 95, wherein the at least one intermediate penetrator segment that contains said explosive element also contains a time-to-go fuse for initiating the explosion of said explosive element.

102. A penetrator in accordance with claim 95, wherein when the fins of said at least one intermediate penetrator segment are in their stowed positions, each fin of said at least one intermediate penetrator segment has an aerodynamic surface which is exposed to air flow, wherein air flow across the aerodynamic surfaces of the fins of said at least one intermediate penetrator segment subsequent to launching of said penetrator causes the fins of said at least one intermediate penetrator segment to open to their deployed positions.

103. A penetrator in accordance with claim 95, wherein the rear portion of each of said at least one intermediate penetrator segment has at least four fins.

104. A penetrator in accordance with claim 95, wherein the fins of each one of said at least one intermediate penetrator segment are mounted around the circumference of the rear portion of the respective intermediate penetrator segment, each fin being pivotally mounted to the rear portion of the respective intermediate penetrator segment by at least one pivot pin, each of said at least one pivot pin being in a plane that is generally perpendicular to the longitudinal axis of said penetrator.

105. A penetrator in accordance with claim 95, wherein said penetrator has at least four penetrator segments.

106. A penetrator in accordance with claim 95, wherein said penetrator has at least eight penetrator segments.

107. A penetrator in accordance with claim 95, wherein the rear portion of each of said at least one intermediate penetrator segment has a diameter that is less than the maximum diameter of the nose portion of the respective intermediate penetrator segment, whereby when the fins of the respective intermediate penetrator segment are in their stowed positions, they do not protrude radially outwardly beyond the maximum diameter of the nose portion of the respective intermediate penetrator segment.

108. A penetrator in accordance with claim 95, wherein each of the fins of said at least one intermediate penetrator segment has a longitudinal axis, whereby when the fins of said at least one intermediate penetrator segment are in their stowed positions, the longitudinal axis of each of the fins of said at least one intermediate penetrator segment is generally parallel to the longitudinal axis of said penetrator, and when the fins of said at least one intermediate penetrator segment are in their deployed positions, the longitudinal axis of each of the thus deployed fins of said at least one intermediate penetrator segment is at an angle to the longitudinal axis of said penetrator.

* * * * *

UNITED STATES PATENT AND TRADEMARK OFFICE

CERTIFICATE OF CORRECTION

PATENT NO. : 5,988,071
DATED : November 23, 1999
INVENTOR(S) : Robert J. Taylor

It is certified that error appears in the above-identified patent and that said Letters Patent is hereby corrected as shown below:

Column 16, claim 16,
Line 31, after "positions", insert -- , --.

Column 22, claim 48,
Line 19, delete "with", and insert -- in --.

Column 30, claim 95,
Line 61, delete the first instance of "of".

Signed and Sealed this

Eleventh Day of September, 2001

*Attest:*

Nicholas P. Godici

NICHOLAS P. GODICI
*Acting Director of the United States Patent and Trademark Office*

*Attesting Officer*